US012624626B2

(12) United States Patent
Hanson et al.

(10) Patent No.: US 12,624,626 B2
(45) Date of Patent: May 12, 2026

(54) CALIBRATION FOR MUDLOGGING

(71) Applicant: Chevron U.S.A. Inc., San Ramon, CA (US)

(72) Inventors: Scott Alan Hanson, Houston, TX (US); Marcus Oliver Wigand, Missouri City, TX (US); Luisa Carolina Crousse, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 565 days.

(21) Appl. No.: 18/177,600

(22) Filed: Mar. 2, 2023

(65) Prior Publication Data

US 2024/0295170 A1 Sep. 5, 2024

(51) Int. Cl.

| | |
|---|---|
| ***E21B 44/00*** | (2006.01) |
| ***E21B 47/07*** | (2012.01) |
| ***E21B 49/00*** | (2006.01) |

(52) U.S. Cl.

CPC ..... *E21B 44/00* (2013.01); *E21B 47/07* (2020.05); *E21B 49/005* (2013.01)

(58) Field of Classification Search

None

See application file for complete search history.

(56) References Cited

U.S. PATENT DOCUMENTS

| | | | | |
|---|---|---|---|---|
| 5,010,765 | A * | 4/1991 | Duckworth | E21B 44/00 73/152.49 |
| 5,984,023 | A * | 11/1999 | Sharma | E21B 47/11 175/58 |
| 6,003,620 | A * | 12/1999 | Sharma | E21B 47/11 175/58 |
| 2009/0166088 | A1* | 7/2009 | Jeffryes | E21B 10/00 175/50 |
| 2012/0012392 | A1* | 1/2012 | Kumar | E21B 10/02 175/332 |
| 2013/0152665 | A1* | 6/2013 | Dunlop | G01N 1/2294 73/19.09 |
| 2015/0337654 | A1* | 11/2015 | Alshannaq | E21B 49/02 175/40 |
| 2017/0306713 | A1* | 10/2017 | Connell | E21B 34/14 |

* cited by examiner

*Primary Examiner* — Lina Cordero

(74) *Attorney, Agent, or Firm* — Smith & Woldesenbet Law Group, PLLC

(57) ABSTRACT

A method for measuring gas volume during mudlogging of a subterranean field operation may include obtaining measurements for a plurality of parameters associated with a core sample retrieved from a subterranean formation, where the plurality of parameters are measured while the core sample is under downhole conditions, and where the plurality of parameters comprises a volume of fluid in a gaseous state. The method may also include applying the measurements to an algorithm to generate a calibrated algorithm, where the calibrated algorithm is used to generate an output based on measurements made during the mudlogging.

19 Claims, 9 Drawing Sheets

CALIBRATION FOR MUDLOGGING

TECHNICAL FIELD

The present application is related to subterranean field operations and, more particularly, to calibration for mudlogging.

BACKGROUND

Mudlogging is used by companies during drilling operations of a wellbore to measure the type and amount of subterranean resources that are available in the adjacent subterranean formation at certain depths of the wellbore. Unfortunately, without proper calibration of the algorithms used to analyze the components of the return fluids, the outputs of the mudlogging process are inaccurate.

SUMMARY

In general, in one aspect, the disclosure relates to a method for measuring gas volume during mudlogging of a subterranean field operation. The method can include obtaining measurements for a plurality of parameters associated with a core sample retrieved from a subterranean formation, where the plurality of parameters are measured while the core sample is under downhole conditions, and where the plurality of parameters comprises a volume of fluid in a gaseous state. The method can also include applying the measurements to an algorithm to generate a calibrated algorithm, where the calibrated algorithm is used to generate an output based on measurements made during the mudlogging.

In another aspect, the disclosure relates to a system for calibrating gas volume measurements during a subterranean field operation. The system can include a calibration engine that is configured to obtain, from a core sample testing system, measurements for a plurality of parameters associated with a core sample retrieved from a subterranean formation, where the plurality of parameters are measured while the core sample is under downhole conditions, and where the plurality of parameters comprises a volume of fluid in a gaseous state. The calibration engine can also be configured to apply the measurements to an algorithm to generate a calibrated algorithm, where the calibrated algorithm is used to generate gas volumes based on measurements made during the mudlogging.

In yet another aspect, the disclosure relates to a method for testing a core sample to calibrate gas volume measurements during a subterranean field operation. The method can include obtaining a core sample encapsulated to capture in situ conditions present at a subterranean formation from which the core sample is retrieved, where the in situ conditions include a pressure and a temperature. The method can also include measuring a volume of fluid in the core sample at the in situ conditions, where the fluid includes a chemical compound in a gaseous state. The results of measuring the volume of fluid can be used to calibrate measurements during mudlogging.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1:
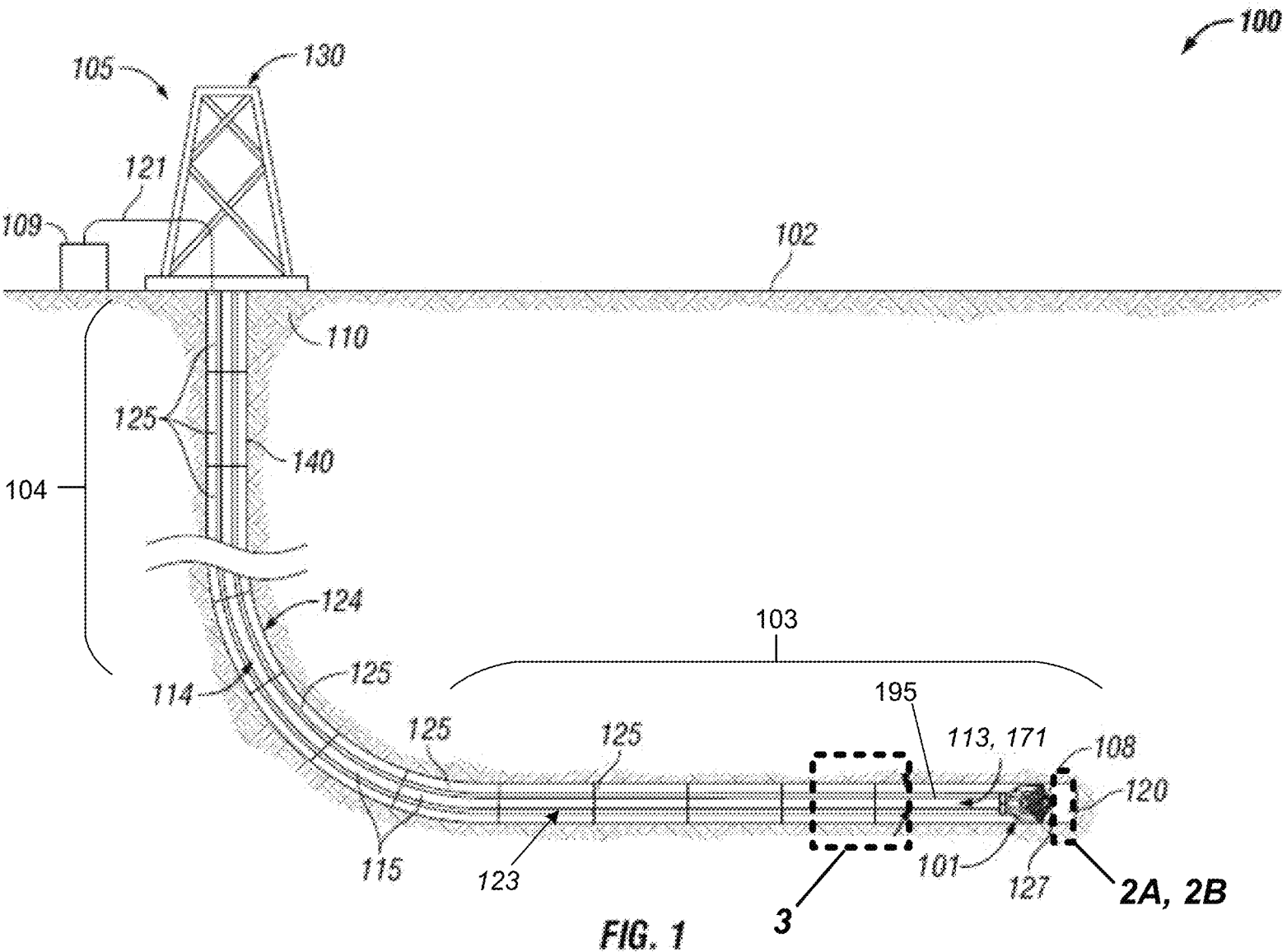
FIG. 1 shows a schematic diagram of a field system with a subterranean wellbore in which example embodiments may be used.

The example embodiments discussed herein are directed to systems, apparatus, methods, and devices for calibration for mudlogging. The subterranean resources captured using example embodiments may include, but are not limited to, oil and natural gas. Creating one or more wellbores using example embodiments and/or using such wellbores with example embodiments may be designed to comply with certain standards and/or requirements. Example embodiments may be used for wellbores drilled in conventional and/or unconventional (e.g., tight shale) subterranean formations and reservoirs.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, unconventional (e.g., a permeability of less than 25 millidarcy (mD) such as a permeability of from 0.000001 mD to 25 mD), diatomite, geothermal, mineral, etc. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geosteering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof. In some embodiments, the same control devices may be used to control fluid flow into and out of the well. In some embodiments, different control devices may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

If a component of a figure is described but not expressly shown or labeled in that figure, the label used for a corresponding component in another figure may be inferred to that component. Conversely, if a component in a figure is labeled but not described, the description for such component may be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of calibration for mudlogging will be described more fully hereinafter with reference to the accompanying drawings, in which example embodiments of calibration for mudlogging are shown. Calibration for mudlogging may, however, be embodied in many different forms and should not be construed as limited to the example embodiments set forth herein. Rather, these example embodiments are provided so that this disclosure will be thorough and complete, and will fully convey the scope of calibration for mudlogging to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. This list of terms is not exclusive. Such terms are not meant to denote a preference or a particular orientation, and they are not meant to limit embodiments of calibration for mudlogging. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2A:
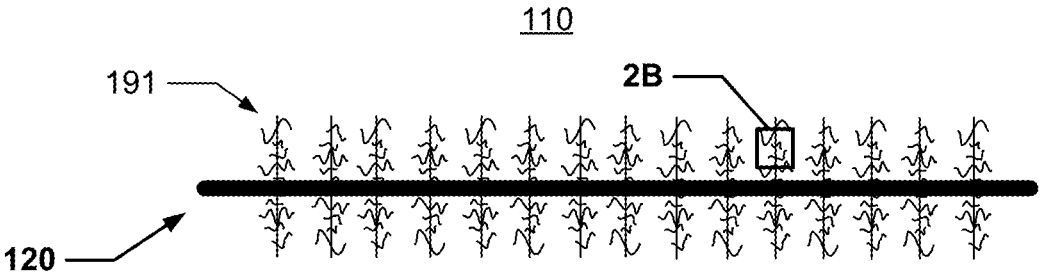
FIGS. 2A and 2B show detailed views of part of the horizontal section of the wellbore of the field system of FIG. 1.
Figure 2B:
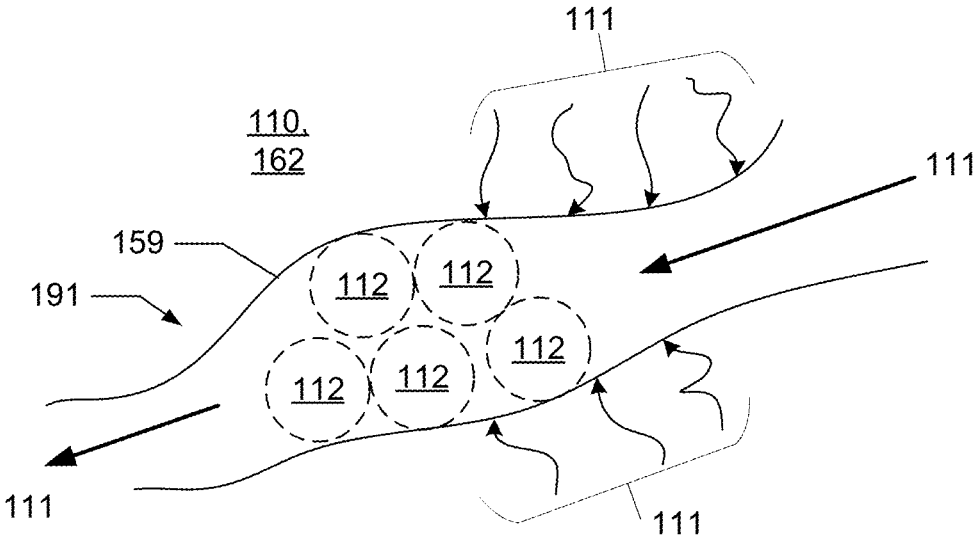
Figure 3:
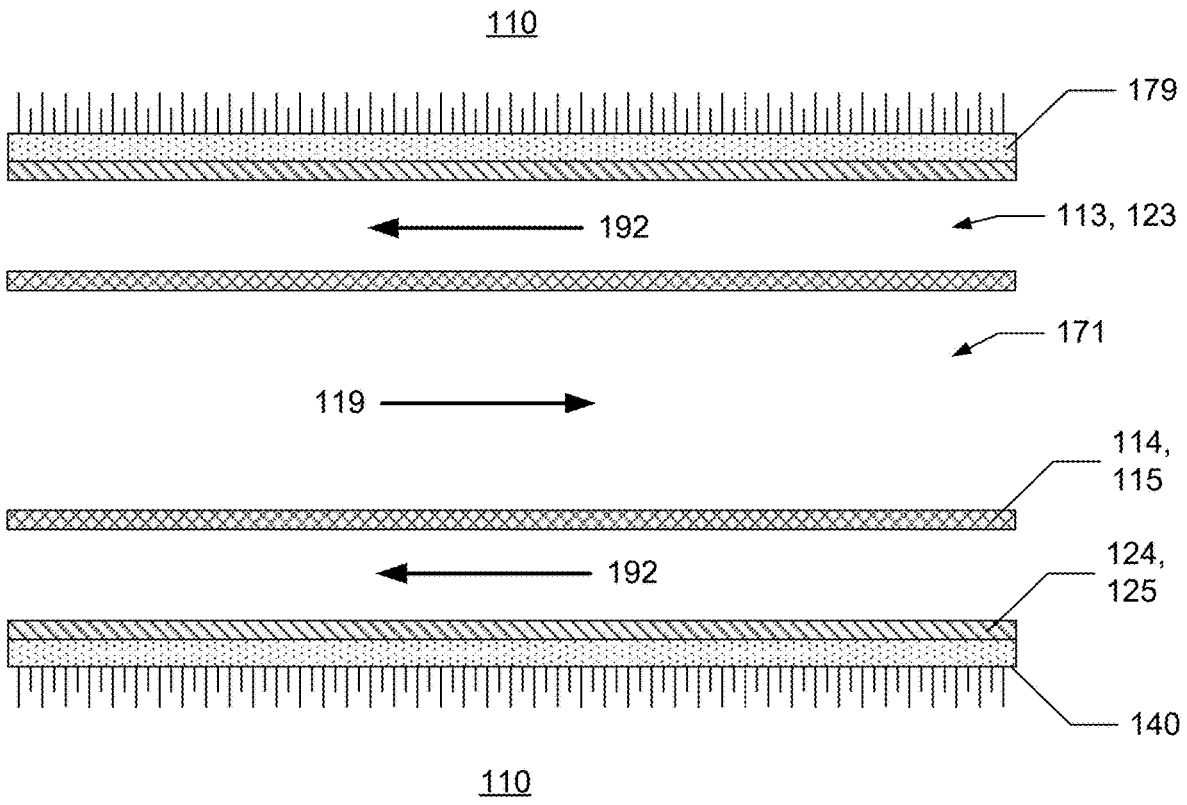
FIG. 3 shows a detailed view of another part of the horizontal section of the wellbore of the field system of FIG. 1.

FIG. 1 shows of a field system 100 with a subterranean wellbore 120 in which example embodiments may be used. FIGS. 2A and 2B show detailed views of part of the horizontal section of the wellbore of the field system of FIG. 1. Specifically, FIG. 2A shows a detail of a substantially horizontal section 103 of the wellbore 120 of FIG. 1. FIG. 2B shows a detail of an induced fracture 191 of FIG. 2A. FIG. 3 shows a detailed view of another part of the horizontal section 103 of the wellbore of FIG. 1. Referring to FIGS. 1 through 3, the wellbore 120 of the field system 100 in this example is bounded by a wall 140 in the subterranean formation 110 and formed using field equipment 130. The field equipment 130 may be located above a surface 102, and/or within the wellbore 120. The surface 102 may be ground level for an on-shore application (as in this case) and the sea floor for an off-shore application. The point where the wellbore 120 begins at the surface 102 may be called the entry point.

The subterranean formation 110 may include one or more of a number of formation types, including but not limited to shale, limestone, sandstone, clay, sand, and salt. In certain embodiments, some or all of the subterranean formation 110 may be unconventional as that term is known by those of ordinary skill in the art. For example, a subterranean formation 110 that is unconventional has a permeability and/or porosity that is so low that the subterranean resource 111 (e.g., oil, natural gas) cannot be extracted economically through a vertical section 104 of the wellbore 120 and instead requires a horizontal section 103 of the wellbore 120 that is subjected to fracturing operations. The subterranean formation 110 may include one or more reservoirs in which one or more subterranean resources 111 (e.g., oil, gas, water, steam) may be located. One or more of a number of field operations (e.g., fracturing, coring, tripping, drilling, setting casing, cementing, production, wireline) may be performed using the field equipment 130 to reach an objective of a user with respect to the subterranean formation 110.

The wellbore 120 may have one or more of a number of segments, where each segment may have one or more of a number of dimensions. Examples of such dimensions may include, but are not limited to, size (e.g., diameter) of the wellbore 120, a curvature of the wellbore 120, a true vertical depth of the wellbore 120, a measured depth of the wellbore 120, a vertical (or substantially vertical) section of the wellbore 120, a horizontal (or substantially horizontal) section of the wellbore 120, and a horizontal displacement of the wellbore 120. The field equipment 130 may be used to create (e.g., drill) and/or develop (e.g., insert casing pipe, extract downhole materials) the wellbore 120. The field equipment 130 may be positioned and/or assembled at the surface 102. The field equipment 130 may include, but is not limited to, a wellbore circulation system 109 (including a circulation line 121), a derrick, a tool pusher, a clamp, a tong, drill pipe, a drill bit, mudlogging equipment, tubing string (also sometimes called tubing pipes), a power source, a tubing string 114, and a casing string 124.

The field equipment 130 may also include one or more devices that measure and/or control various aspects (e.g., direction of wellbore 120, pressure, temperature) of a field operation associated with the wellbore 120. For example, the field equipment 130 may include a wireline tool that is run through the wellbore 120 to provide detailed information (e.g., curvature, azimuth, inclination) throughout the wellbore 120. Such information may be used for one or more of a number of purposes. For example, such information may dictate the size (e.g., outer diameter) of casing pipe 125 to be inserted at a certain depth in the wellbore 120.

Inserted into and disposed within the wellbore 120 of FIG. 1 are a number of casing pipes 125 that are coupled to each other end-to-end to form the casing string 124. In this case, each end of a casing pipe 125 has mating threads (a type of coupling feature) disposed thereon, allowing a casing pipe 125 to be mechanically coupled to an adjacent casing pipe 125 in an end-to-end configuration. The casing pipes 125 of the casing string 124 may be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion 127 of the wellbore 120 extends beyond the casing string 124 at the distal end of the wellbore 120.

Each casing pipe 125 of the casing string 124 may have a length and a width (e.g., outer diameter). The length of a casing pipe 125 may vary. For example, a common length of a casing pipe 125 is approximately 40 feet. The length of a casing pipe 125 may be longer (e.g., 60 feet) or shorter (e.g., 10 feet) than 40 feet. The width of a casing pipe 125 may also vary and may depend on the cross-sectional shape of the casing pipe 125. For example, when the cross-sectional shape of the casing pipe 125 is circular, the width may refer to an outer diameter, an inner diameter, and/or some other form of measurement of the casing pipe 125. Examples of a width in terms of an outer diameter of a casing pipe 125 may include, but are not limited to, 7 inches, 7⅝ inches, 8⅝ inches, 9⅝ inches, 9⅞ inches, 10¾ inches, 13⅜ inches, and 14 inches.

The size (e.g., width, length) of the casing string 124 may be based on the information gathered using field equipment 130 with respect to the wellbore 120. The walls of the casing string 124 have an inner surface that forms a cavity 113 that traverses the length of the casing string 124. Each casing pipe 125 may be made of one or more of a number of suitable materials, including but not limited to stainless steel. Cement 179 is poured into the wellbore 120 (e.g., through the cavity 113 and then forced upward between the outer surface of the casing string 124 and the wall 140 of the subterranean wellbore 120) to adhere the casing string 124 to the wall 140. In some cases, a liner may additionally be used with, or alternatively be used in place of, some or all of the casing pipes 125.

A number of tubing pipes 115 that are coupled to each other and inserted inside the cavity 113 form the tubing string 114. The tubing string 114 may be positioned inside of the casing string 124. The collection of tubing pipes 115 may be called a tubing string 114. The tubing pipes 115 of the tubing string 114 are mechanically coupled to each other end-to-end, usually with mating threads (a type of coupling feature). The tubing pipes 115 of the tubing string 114 may be mechanically coupled to each other directly or using a coupling device, such as a coupling sleeve.

Each tubing pipe 115 of the tubing string 114 may have a length and a width (e.g., outer diameter). The length of a tubing pipe 115 may vary. For example, a common length of a tubing pipe 115 is approximately 30 feet. The length of a tubing pipe 115 may be longer (e.g., 40 feet) or shorter (e.g., 10 feet) than 30 feet. Also, the length of a tubing pipe 115 may be the same as, or different than, the length of an adjacent casing pipe 125. The width of a tubing pipe 115 may also vary and may depend on one or more of a number of factors, including but not limited to the target depth of the wellbore 120, the total length of the wellbore 120, the inner diameter of the adjacent casing pipe 125, and the curvature of the wellbore 120.

The width of a tubing pipe 115 may refer to an outer diameter, an inner diameter, and/or some other form of measurement of the tubing pipe 115. Examples of a width in terms of an outer diameter for a tubing pipe 115 may include, but are not limited to, 7 inches, 5 inches, and 4 inches. The outer diameter of the tubing pipe 115 may be less than the inner diameter of the casing pipe 125, resulting in a gap 123 (also called an annulus 123) between the tubing pipe 115 and the adjacent casing pipe 125. The walls of the tubing pipe 115 have an inner surface that forms a cavity 171 that traverses the length of the tubing pipe 115. The tubing pipe 115 may be made of one or more of a number of suitable materials, including but not limited to steel.

At the distal end of the tubing string 114 within the wellbore 120 is a bottom hole assembly (BHA) 101. The BHA 101 may include one or more of a number of components, including but not limited to a drill bit 108 at the far distal end, a measurement-while-drilling (MWD) tool, one or more collars, one or more subs, and one or more stabilizers. During a field operation, the tubing string 114, including the BHA 101, may be rotated by other field equipment 130. The tubing string 114, BHA 101, and any other pieces of field equipment 130 coupled to one or more of these components may generally be referred to herein as a downhole assembly or a wellbore assembly.

In some cases, as during a coring operation, a specialized tool 195 (e.g., a coring tool used to collect core samples from the subterranean formation 110 and maintain the core samples at their in situ conditions (e.g., temperature, pressure)) may be integrated with or placed above the BHA 101 as part of the tubing string 114. When different field operations are undertaken in the wellbore 120, the wellbore assembly (or portions thereof, such as the BHA 101) may be removed (i.e., brought to the surface 102 or tripped out) and reassembled with different field equipment 130 and/or in a different arrangement.

The wellbore circulation system 109 may include one or more of a number of components that allow a user to control the one or more downhole components (e.g., a portion of the BHA 101) from the surface 102. The wellbore circulation system 109 may also include one or more of a number of components that allow an initial fluid 119 (e.g., drilling fluid, fracturing fluid, water) to flow from the surface 102 down the cavity 171 of the tubing string 114, out the BHA 101, and up the annulus 123 between the tubing string 114 and the casing string 124, as shown in FIG. 3. Examples of such components of the wellbore circulation system 109 may include, but are not limited to, a compressor, a valve, a pump, piping, and a motor.

When the initial fluid 119 reaches the end of the wellbore 120, a return fluid 192 travels up the annulus 123 to the surface 102. The return fluid 192 includes the initial fluid 119 mixed with other components (e.g., rock cuttings, subterranean resources 111, gases, formation water) that reach the wellbore 120 from the subterranean formation 110. In some cases, when the field equipment 130 includes mudlogging equipment, the mudlogging equipment may take a sample of the return fluid 192 to analyze one or more of the other components (e.g., determine the type and/or quantity of subterranean formation 110 and/or subterranean resources 111 at a particular depth of the wellbore 120) of the return fluid 192 that were not present in the initial fluid 119. For example, the mudlogging equipment may include a gas trap or gas extractor that may extract, measure, and analyze some of the gases dissolved in the return fluid 192.

The initial fluid 119 may include one or more of a number of components. Such components of the initial fluid 119 may include, but are not limited to, one or more clays, one or more chemical additives (e.g., an acid, a chelant), an oil base, and a water base. Pumping the initial fluid 119 downhole through the cavity 171 of the tubing string 114 may serve one or more of a number of purposes. Such purposes may include, but are not limited to, controlling formation pressure at the wellbore 120; cleaning the wellbore 120 of formation debris; lubricating, cleaning, and cooling the drill bit 108, the rest of the BHA 101, and the tubing string 114; stabilizing the wellbore 120; and limiting the loss of initial fluid 119 to the subterranean formation 110.

While not shown in FIG. 1, there may be multiple wellbores 120, each with its own wellhead but that is located close to the other wellheads, drilled into the subterranean formation 110 and having substantially horizontal sections 103 that are close to each other. In such a case, the multiple wellbores 120 may be drilled at the same pad or at different pads. When the drilling process is complete, other operations, such as fracturing operations, may be performed. A fracturing operation may enhance existing fractures 191 in the subterranean formation 110 and/or create new fractures 191 in the subterranean formation 110.

The fractures 191 shown in FIG. 2A may be naturally-occurring or induced. The fractures 191 in FIG. 2A are located in the horizontal section 103 of the wellbore 120 in FIG. 1. The fractures 191, whether induced and/or naturally occurring, may additionally or alternatively be located in other sections (e.g., a substantially vertical section, a transition area between a vertical section and a horizontal section) of the wellbore 120. The fractures 191 provide paths for formation water, gases, subterranean resources 111, and/or any other components in the subterranean formation 110 to enter the wellbore 120.

Operations that induce fractures 191 in the subterranean formation 110 use any of a number of fluids that include proppant 112 (e.g., sand, ceramic pellets). When proppant 112 is used, some of the fractures 191 (also sometimes called principal or primary fractures) receive proppant 112, while a remainder of the fractures 191 (also sometimes called secondary fractures) do not have any proppant 112 in them. As shown in FIG. 2B, when proppant 112 is used, the proppant 112 is designed to become lodged inside at least some of the induced fractures 191 to keep those fractures 191 open after the fracturing operation is complete. While the shape of the proppant 112 is shown as being uniformly spherical, and the size is substantially identical among the proppant 112, the actual sizes and shapes of the proppant 112 may vary.

The use of proppant 112 in certain types of subterranean formation 110, such as shale and other tight (unconventional) formations, may be important. For example, the rock matrix 162 of shale formations typically have permeabilities on the order of microdarcys (μD) to nanodarcys (nD). When fractures 191 are induced in such formations with low permeabilities, it is important to sustain the fractures 191 and their conductivity for an extended period of time in order to extract more of the subterranean resources 111.

The induced fractures 191 create a volume within the subterranean formation 110 where the rock matrix 162 of the subterranean formation 110 is connected to the high conductivity fractures 191 located a short distance away. In addition to different configurations of the fractures 191, other factors that may contribute to the viability of the subterranean formation 110 may include, but are not limited to, permeability of the rock matrix 162, capillary pressure, and the temperature and pressure of the subterranean formation 110. Each fracture 191, whether induced or naturally occurring, is defined by a wall 159, also called a frac face 159 herein. The frac face 159 provides a transition between the paths formed by the rock matrices 162 in the subterranean formation 110 and the fracture 191. The subterranean resources 111 flow through the paths formed by the rock matrices 162 in the subterranean formation 110 into the fracture 191, and then on to the wellbore 120.

Figure 4:
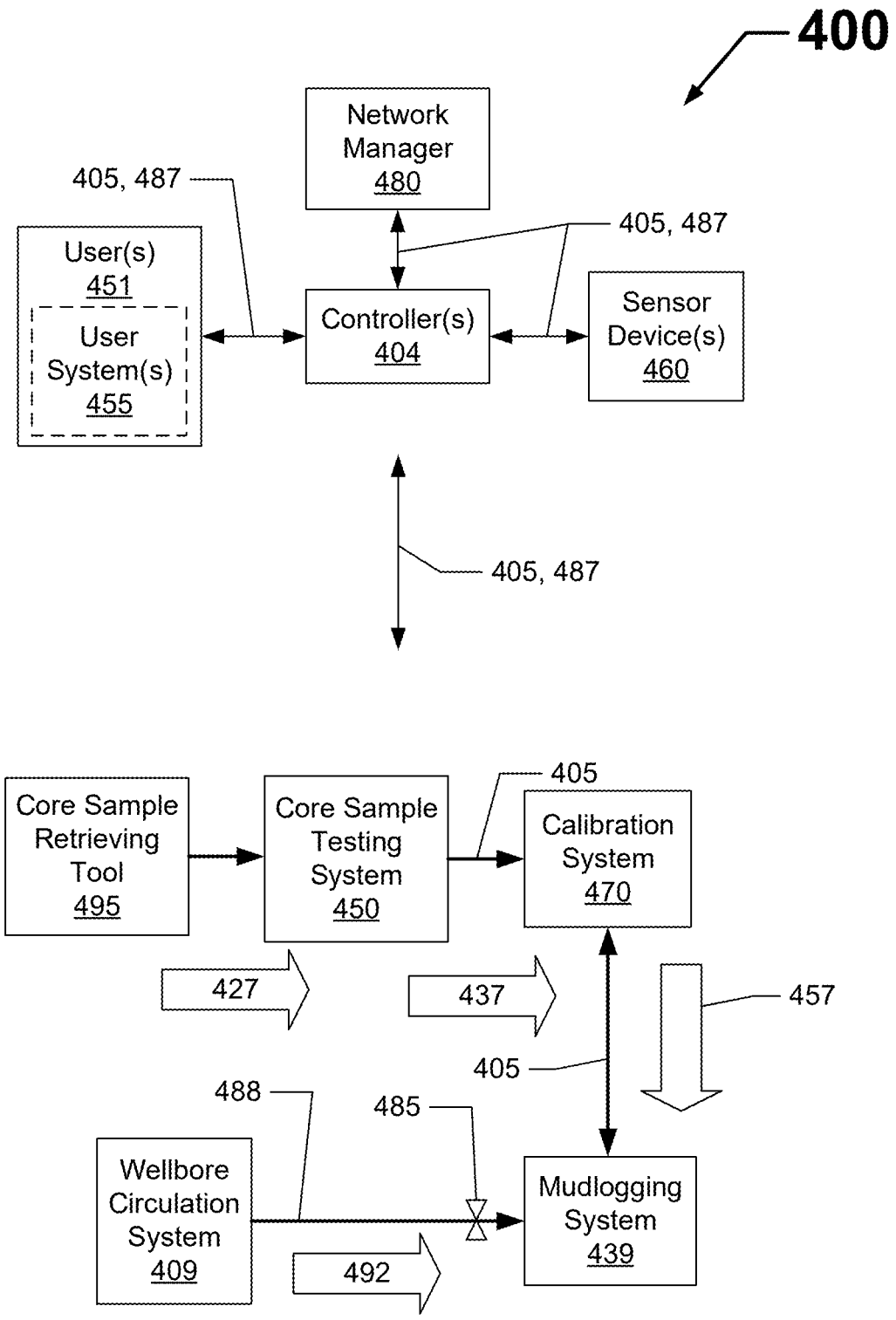
FIG. 4 shows a diagram of a system for calibrating for mudlogging according to certain example embodiments.

FIG. 4 shows a diagram of a system 400 for calibrating gas volume measurements during a subterranean field operation according to certain example embodiments. The system 400 of FIG. 4 includes a core sample retrieving tool 495, a calibration system 470, a core sample testing system 450, a wellbore circulation system 409, a mudlogging system 439, one or more controllers 404, one or more sensor devices 460, one or more users 451 (including one or more optional user systems 455), a network manager 480, piping 488, and one or more valves 485.

The components shown in FIG. 4 are not exhaustive, and in some embodiments, one or more of the components shown in FIG. 4 may not be included in the example system 400. Any component of the system 400 may be discrete or combined with one or more other components of the system 400. Also, one or more components of the system 400 may have different configurations. For example, one or more sensor devices 460 may be disposed within or disposed on other components (e.g., the piping 488, a valve 485, the calibration system 470, the core sample testing system 450). As another example, a controller 404, rather than being a stand-alone device, may be part of one or more other components (e.g., the calibration system 470, the core sample testing system 450, the mudlogging system 439) of the system 400.

Referring to FIGS. 1 through 4, the wellbore circulation system 409, which is substantially similar to the wellbore circulation system 109 of FIG. 1, circulates a return fluid 492 (substantially similar to the return fluid 192 discussed above) to the surface (e.g., surface 102). The mudlogging system 439, part of the field equipment (e.g., field equipment 130), receives the return fluid 492 from the wellbore circulation system 409. The mudlogging system 439 may receive the return fluid 492 from the wellbore circulation system 409 continuously, periodically, randomly, or at some other interval of time.

The mudlogging system 439 is configured to create a detailed record of the wellbore (e.g., wellbore 120) by examining the return fluid 492 (e.g., cuttings of rock, gases, subterranean resources 111) brought to the surface (e.g., surface 102) by the wellbore circulation system 409. The mudlogging system 439 may include one or more sensor devices (e.g., sensor devices 460) that are used to measure one or more parameters associated with some or all of the content of the return fluid 492. For example, the mudlogging system 439 may include a gas trap or gas extractor that is configured to receive a small amount of the return fluid 492 and is used to extract some or all of the gases (e.g., from the subterranean formation 110 and that are dissolved in the initial fluid) in the return fluid 492. Such gases (sometimes called gas-in-mud) may typically include light hydrocarbons (e.g., methane, ethane, propane, butane, pentane). Sensor devices of the mudlogging system 439 used to identify and measure these gases may be or include a gas chromatograph.

The mudlogging system 439 in some cases is also configured to use the measurements of the parameters associated with the return fluid 492 to make determinations and/or recommendations. In such cases, the mudlogging system 439 may include a controller (e.g., controller 404) with components such as a control engine, a communication module, and a storage repository (with protocols and algorithms), all of which are discussed below with respect to FIG. 5. The results (e.g., data, recommendations) of the mudlogging system 439 may be delivered to a user 451, including potentially a user system 455.

Gas-in-mud values measured by the mudlogging system 439 during drilling of the wellbore (e.g., wellbore 120) may be corrected to the volume of gas per volume of rock measured in the return fluid 492 at the surface (e.g., surface 102) if the gas trap response factors (or equivalent if a different type of sensor device is used) are known. However, if the gas extraction components of the mudlogging system 439 have not been fully characterized, gas-in-air values cannot be corrected to gas-in-mud values. This may make the output (e.g., analysis, recommendations) of the mudlogging system 439 inaccurate and unreliable. Example embodiments are designed to accurately calibrate mudlogging system 439 (or portions thereof) so that the mudlogging system 439 is fully characterized, making the output of the mudlogging system 439 accurate and reliable.

The core sample retrieving tool 495 of the system 400 is a type of specialized tool 195 of the BHA (e.g., BHA 101) or other part of the tubing string (e.g., tubing string 114), as discussed above. The core sample retrieving tool 495 is configured to capture one or more core samples 427 (also sometimes called core plugs 427) from the subterranean resource (e.g., subterranean resource 111) adjacent to the wellbore (e.g., wellbore 120). Each core sample 427 is captured so that the in situ conditions (e.g., pressure, temperature) of the core sample 427 are maintained or otherwise controlled within the core sample retrieving tool 495. Maintaining the in situ conditions of the core samples 427 allows the gases and other components in the rock to maintain their characteristics (e.g., volume, state).

The core sample testing system 450 of the system 400 is configured to receive the core samples 427 from the core sample retrieving tool 495 and test and measure values of parameters for each core sample 427. Once testing on a core sample 427 is complete, the core sample testing system 450 is configured to send the measurements 437 to the calibration system 470 using one or more communication links 405 (discussed below). In some cases, the core sample testing system 450 may include one or more sensor devices (e.g., sensor devices 460) that are used to measure one or more parameters associated with some or all of the content of a core sample 427. For example, the core sample testing system 450 may include one or more sensor devices 460 in the form of equipment configured to measure fluid volumes (e.g., volumes of light hydrocarbons) in a core sample 427. In addition, or in the alternative, the core sample testing system 450 may include one or more sensor devices 460 in the form of a gas chromatograph that may measure the gases (e.g., the light hydrocarbons) in a core sample 427. In some cases, the core sample testing system 450 may include one or more sensor devices 460 that allow for nuclear magnetic resonance (NMR) spectroscopy of a core sample 427 or portions thereof.

The core sample testing system 450 in some cases is also configured to use the measurements of the parameters associated with a core sample 427 to make determinations and/or recommendations. In such cases, the core sample testing system 450 may include a controller (e.g., controller 404) with components such as a control engine, a communication module, and a storage repository (with protocols and algorithms), all of which are discussed below with respect to FIG. 5. The results (e.g., data, recommendations) of the core sample testing system 450 may be delivered to a user 451, including potentially a user system 455.

The example calibration system 470 of the system 400 may be configured to use the measurements 437 of the core sample testing system 450 to generate a calibrated algorithm 457 that is delivered to the mudlogging system 439 using one or more communication links 405 (discussed below). Specifically, the calibration system 470 may be configured to obtain the measurements 437 for a plurality of parameters associated with a core sample 427 retrieved from a subterranean formation (e.g., subterranean formation 110), where the parameters are measured while the core sample 427 is under downhole (in situ) conditions, and where the parameters include a volume of fluid (e.g., a light hydrocarbon) in a gaseous state.

The example calibration system 470 of the system 400 may also be configured to apply the measurements to an algorithm used by the mudlogging system 439 to generate a calibrated algorithm, where the calibrated algorithm is used by the mudlogging system 439 to generate an output based on measurements made by the mudlogging system 439 during mudlogging. The output generated by the calibrated algorithm may be directed to one or more of any of a number of parameters, including but not limited to a gas volume, an oil volume, a fluid saturation level, and porosity.

When a measurement 437 of the core sample testing system 450 is the volume of a fluid (e.g., a light hydrocarbon gas) in the core sample 427, this fluid volume may be used to correct the gas volumes measured in the return fluids 492 by the mudlogging system 439 during drilling. The fluids collected from the core plugs 427 may also be analyzed by the core sample testing system 450 using a gas chromatograph, and the example calibration system 470 may compare these measurements 437 to the gas chromatograph data of the return fluids 492 measured by the mudlogging system 439. The gas analysis results (measurements 437) from the recovered gas of the core samples 427 may also be used to correct each gas component measured in the return fluids 492 by the mudlogging system 439 in the mudlogging process. If the volume of one or more gases is not able to be measured by the core sample testing system 450 for a particular core sample 427, an average value of volumes for a gas that is measurable in other core samples 427 by the core sample testing system 450 may be used by the calibration system 470 to match average gas values from the return fluid 492, measured by the mudlogging system 439, over the same interval.

The piping 488 that delivers the return fluid 492 from the wellbore circulation system 409 to the mudlogging system 439 may include multiple pipes, ducts, elbows, joints, sleeves, collars, and similar components that are coupled to each other (e.g., using coupling features such as mating threads. Each component of the piping 488 may have an appropriate size (e.g., inner diameter, outer diameter) and be made of an appropriate material (e.g., steel, PVC) to safely and efficiently handle the pressure, temperature, flow rate, and other characteristics of the return fluid 492 and/or other types of fluid (e.g., the initial fluid), as applicable.

There may be a number of valves 485 placed in-line with the piping 488 at various locations in the system 400 to control the flow of a fluid (e.g., the return fluid 492) therethrough. A valve 485 may have one or more of any of a number of configurations, including but not limited to a guillotine valve, a ball valve, a gate valve, a butterfly valve, a pinch valve, a needle valve, a plug valve, a diaphragm valve, and a globe valve. One valve 485 may be configured the same as or differently compared to another valve 485 in the system 400. Also, one valve 485 may be controlled (e.g., manually, automatically by the controller 404) the same as or differently compared to another valve 485 in the system 400.

The system 400 may include one or more controllers 404. A controller 404 of the system 400 communicates with and in some cases controls one or more of the other components (e.g., a sensor device 460, the mudlogging system 439, the calibration system 470, the core sample testing system 450) of the system 400. A controller 404 performs a number of functions that include obtaining and sending data, evaluating data, following protocols, running algorithms, and sending commands. A controller 404 may include one or more of a number of components. As discussed below with respect to FIG. 5, such components of a controller 404 may include, but are not limited to, a control engine, a calibration module, a communication module, a timer, a counter, a power module, a storage repository, a hardware processor, memory, a transceiver, an application interface, and a security module. When there are multiple controllers 404 (e.g., one controller 404 for a mudlogging system 439, another controller 404 for the calibration system 470, yet another controller 404 for the core sample testing system 450), each controller 404 may operate independently of each other. Alternatively, one or more of the controllers 404 may work cooperatively with each other. As yet another alternative, one of the controllers 404 may control some or all of one or more other controllers 404 in the system 400. Each controller 404 may be considered a type of computer device, as discussed below with respect to FIG. 6.

Each sensor device 460 includes one or more sensors that measure one or more parameters (e.g., pressure, flow rate, temperature, humidity, fluid content, voltage, current, permeability, porosity, rock characteristics, chemical elements or compounds in a fluid, chemical elements or compounds in a solid). Examples of a sensor of a sensor device 460 may include, but are not limited to, a temperature sensor, a flow sensor, a pressure sensor, a gas spectrometer, a voltmeter, an ammeter, a permeability meter, a porosimeter, and a camera. A sensor device 460 may be integrated with or measure a parameter associated with one or more components of the system 400. For example, a sensor device 460 may be configured to measure a parameter (e.g., volume, permeability, flow rate, pressure, temperature) of a core sample 427, a return fluid 492, and/or some other component of the system 400.

As another example, a sensor device 460 may be configured to determine how open or closed a valve 485 within the system 400 is. As yet another example, one or more sensor devices 460 may be used to identify a chemistry composition of the return fluid 492 and/or a core sample 427. In some cases, a number of sensor devices 460, each measuring a different parameter, may be used in combination to determine and confirm whether a controller 404 should take a particular action (e.g., update and send a calibrated algorithm 457 to the mudlogging system 439, operate a valve 485, operate or adjust the operation of the core sample testing system 450, operate or adjust the operation of the mudlogging system 439). When a sensor device 460 includes its own controller 404 (or portions thereof), then the sensor device 460 may be considered a type of computer device, as discussed below with respect to FIG. 6.

A user 451 may be any person that interacts, directly or indirectly, with the calibration system 470 and/or any other component of the system 400. Examples of a user 451 may include, but are not limited to, a business owner, an engineer, a company representative, a geologist, a consultant, a chemist, a drilling engineer, a contractor, and a manufacturer's representative. A user 451 may use one or more user systems 455, which may include a display (e.g., a GUI). A user system 455 of a user 451 may interact with (e.g., send data to, obtain data from) the controller 404 via an application interface and using the communication links 405. The user 451 may also interact directly with the controller 404 through a user interface (e.g., keyboard, mouse, touchscreen).

The network manager 480 is a device or component that controls all or a portion (e.g., a communication network, the controller 404) of the system 400. The network manager 480 may be substantially similar to the controller 404, as described above. For example, the network manager 480 may include a controller that has one or more components and/or has similar functionality to some or all of the controller 404. Alternatively, the network manager 480 may include one or more of a number of features in addition to, or altered from, the features of the controller 404. As described herein, control and/or communication with the network manager 480 may include communicating with one or more other components of the same system 400 or another system. In such a case, the network manager 480 may facilitate such control and/or communication. The network manager 480 may be called by other names, including but not limited to a master controller, a network controller, and an enterprise manager. The network manager 480 may be considered a type of computer device, as discussed below with respect to FIG. 6.

Interaction between each controller 404, the sensor devices 460, the users 451 (including any associated user systems 455), the network manager 480, and other components (e.g., the valves 485, the mudlogging system 439, the calibration system 470, and the core sample testing system 450) of the system 400 may be conducted using communication links 405 and/or power transfer links 487. Each communication link 405 may include wired (e.g., Class 1 electrical cables, Class 2 electrical cables, electrical connectors, Power Line Carrier, RS485) and/or wireless (e.g., Wi-Fi, Zigbee, visible light communication, cellular networking, Bluetooth, Bluetooth Low Energy (BLE), ultra-wide band (UWB), WirelessHART, ISA100) technology. A communication link 405 may transmit signals (e.g., communication signals, control signals, data) between each controller 404, the sensor devices 460, the users 451 (including any associated user systems 455), the network manager 480, and the other components of the system 400.

Each power transfer link 487 may include one or more electrical conductors, which may be individual or part of one or more electrical cables. In some cases, as with inductive power, power may be transferred wirelessly using power transfer links 487. A power transfer link 487 may transmit power between each controller 404, the sensor devices 460, the users 451 (including any associated user systems 455), the network manager 480, and the other components of the system 400. Each power transfer link 487 may be sized (e.g., 12 gauge, 18 gauge, 4 gauge) in a manner suitable for the amount (e.g., 480V, 24V, 120V) and type (e.g., alternating current, direct current) of power transferred therethrough.

Figure 5:
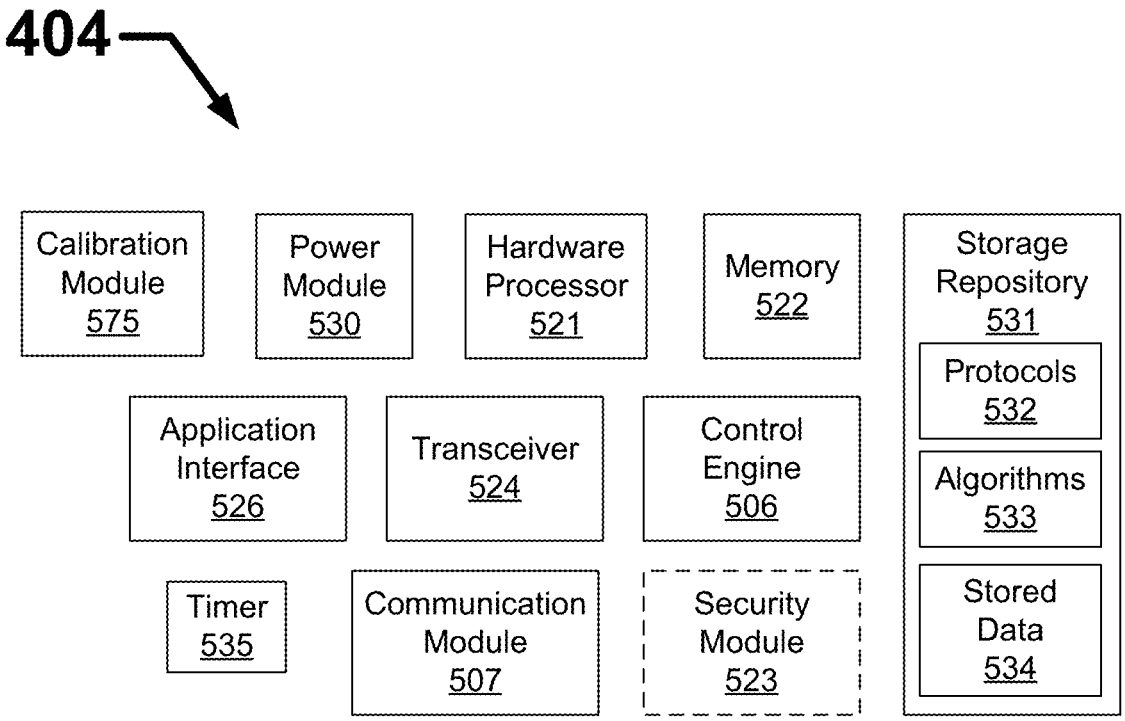
FIG. 5 shows a system diagram of a controller according to certain example embodiments.

FIG. 5 shows a system diagram of a controller 404, in this case for the calibration system 470, according to certain example embodiments. Referring to FIGS. 1 through 5, the controller 404 may be substantially the same as a controller 404 discussed above with respect to FIG. 4. The controller 404 includes multiple components. In this case, the controller 404 of FIG. 5 includes a control engine 506, a calibration module 575, a communication module 507, a timer 535, a power module 530, a storage repository 531, a hardware processor 521, a memory 522, a transceiver 524, an application interface 526, and, optionally, a security module 523. The controller 404 (or components thereof) may be located at or near the various components of the system 400. In addition, or in the alternative, the controller 404 (or components thereof) may be located remotely from (e.g., in the cloud, at an office building) the various components of the system 400.

The storage repository 531 may be a persistent storage device (or set of devices) that stores software and data used to assist the controller 404 in communicating with one or more other components of a system, such as the users 451 (including associated user systems 455), the mudlogging system 439, the core sample testing system 450, the network manager 480, and the sensor devices 460 of the system 400 of FIG. 4 above. In one or more example embodiments, the storage repository 531 stores one or more protocols 532, algorithms 533, and stored data 534.

The protocols 532 of the storage repository 531 may be any procedures (e.g., a series of method steps) and/or other similar operational processes that the control engine 506 of the controller 404 follows based on certain conditions at a point in time. The protocols 532 may include any of a number of communication protocols that are used to send and/or obtain data between the controller 404 and other components of a system (e.g., system 400). Such protocols 532 used for communication may be a time-synchronized protocol. Examples of such time-synchronized protocols may include, but are not limited to, a highway addressable remote transducer (HART) protocol, a wirelessHART protocol, and an International Society of Automation (ISA) 100 protocol. In this way, one or more of the protocols 532 may provide a layer of security to the data transferred within a system (e.g., system 400). Other protocols 532 used for communication may be associated with the use of Wi-Fi, Zigbee, visible light communication (VLC), cellular networking, BLE, UWB, and Bluetooth.

The algorithms 533 may be any formulas, mathematical models, forecasts, simulations, and/or other similar tools that the control engine 506 of the controller 404 uses to reach a computational conclusion. For example, one or more algorithms 533 may be used, in conjunction with one or more protocols 532, to assist the controller 404 to determine when to start, adjust, and/or stop the operation of the mudlogging system 439, the rest of the calibration system 470 and/or the core sample testing system 450. As another example, one or more algorithms 533 may be used, in conjunction with one or more protocols 532, to assist the controller 404 to generate a calibrated algorithm 457 that is used by the mudlogging system 439.

Stored data 534 may be any data associated with a field (e.g., the subterranean formation 110, the fractures 191 adjacent to a wellbore 120, the characteristics of proppant 112 used in a field operation), other fields (e.g., other wellbores and subterranean formations), the other components (e.g., the user systems 455, the calibration system 470, the calibrated algorithms 457, the core sample testing system 450, the mudlogging system 439), including associated equipment (e.g., motors, pumps, compressors), of the system 400, additional known parameters (e.g., drill rate, size of the drill bit 108, pump rate of the initial fluid 119 into the wellbore 120) of a current field operation, measurements 437 of parameters associated with a core sample 427, measurements of parameters associated with the return fluid 492 (or portions thereof), other measurements made by the sensor devices 460, threshold values, tables, results of previously run or calculated algorithms 533, prior versions of algorithms 533, updates to protocols 532, user preferences, and/or any other suitable data. Such data may be any type of data, including but not limited to historical data, present data, and future data (e.g., forecasts). The stored data 534 may be associated with some measurement of time derived, for example, from the timer 535.

Examples of a storage repository 531 may include, but are not limited to, a database (or a number of databases), a file system, cloud-based storage, a hard drive, flash memory, some other form of solid-state data storage, or any suitable combination thereof. The storage repository 531 may be located on multiple physical machines, each storing all or a portion of the protocols 532, the algorithms 533, and/or the stored data 534 according to some example embodiments. Each storage unit or device may be physically located in the same or in a different geographic location relative to another storage unit or device.

The storage repository 531 may be operatively connected to the control engine 506. In one or more example embodiments, the control engine 506 includes functionality to communicate with the users 451 (including associated user systems 455), the sensor devices 460, the network manager 480, and the other components in the system 400. More specifically, the control engine 506 sends information to and/or obtains information from the storage repository 531 in order to communicate with the users 451 (including associated user systems 455), the sensor devices 460, the network manager 480, and the other components of the system 400. As discussed below, the storage repository 531 may also be operatively connected to the communication module 507 in certain example embodiments.

In certain example embodiments, the control engine 506 of the controller 404 controls the operation of one or more components (e.g., the communication module 507, the timer 535, the transceiver 524) of the controller 404. For example, the control engine 506 may activate the communication module 507 when the communication module 507 is in "sleep" mode and when the communication module 507 is needed to send data obtained from another component (e.g., a sensor device 460) in the system 400. In addition, the control engine 506 of the controller 404 may control the operation of one or more other components (e.g., the mudlogging system 439, the core sample testing system 450, the wellbore circulation system 409), or portions thereof, of the system 400.

The control engine 506 of the controller 404 may communicate with one or more other components of the system 400. For example, the control engine 506 may use one or more protocols 532 to facilitate communication with the sensor devices 460 to obtain data (e.g., measurements of various parameters, such as temperature, pressure, and flow rate), whether in real time or on a periodic basis and/or to instruct a sensor device 460 to take a measurement. The control engine 506 may use measurements 437 of parameters taken by sensor devices 460 from a core sample 427 extracted from a subterranean formation by the core sample retrieving tool 495 and tested by the core sample testing system 450, as well as one or more protocols 532 and/or algorithms 533, to analyze the contents (e.g., interpret the measurements 437) of the core sample 427. As yet another example, the control engine 506 may use one or more algorithms 533 and/or protocols 532 to recommend replacing an algorithm used by the mudlogging system 439 with a calibrated algorithm 457 based on the analysis of the measurements 437 received from the core sample testing system 450 in an attempt to optimize operational capability in a particular stage of a field operation.

The control engine 506 may generate and process data associated with control, communication, and/or other signals sent to and obtained from the users 451 (including associated user systems 455), the sensor devices 460, the network manager 480, and the other components of the system 400. In certain embodiments, the control engine 506 of the controller 404 may communicate with one or more components of a system external to the system 400. For example, the control engine 506 may interact with an inventory management system by ordering replacements for components or pieces of equipment (e.g., a sensor device 460, a valve 485, a motor) within the system 400 that has failed or is failing. As another example, the control engine 506 may interact with a contractor or workforce scheduling system by arranging for the labor needed to replace a component or piece of equipment in the system 400. In this way and in other ways, the controller 404 is capable of performing a number of functions beyond what could reasonably be considered a routine task.

In certain example embodiments, the control engine 506 may include an interface that enables the control engine 506 to communicate with the sensor devices 460, the user systems 455, the network manager 480, and the other components of the system 400. For example, if a user system 455 operates under IEC Standard 62386, then the user system 455 may have a serial communication interface that will transfer data to the controller 404. Such an interface may operate in conjunction with, or independently of, the protocols 532 used to communicate between the controller 404 and the users 451 (including corresponding user systems 455), the sensor devices 460, the network manager 480, and the other components of the system 400.

The control engine 506 (or other components of the controller 404) may also include one or more hardware components and/or software elements to perform its functions. Such components may include, but are not limited to, a universal asynchronous receiver/transmitter (UART), a serial peripheral interface (SPI), a direct-attached capacity (DAC) storage device, an analog-to-digital converter, an inter-integrated circuit (I2C), and a pulse width modulator (PWM).

The calibration module 575 of the controller 404 may be configured to convert an algorithm used by the mudlogging system 439 into a calibrated algorithm 457. The calibration module 575 may use one or more measurements 437 of one or more parameters of one or more core samples 427 to generate one or more calibrated algorithms 457. In addition, the calibration module 575 may use one or more measurements of one or more parameters of the return fluid 492, as received from the mudlogging system 439 through one or more of the communication links 405, to generate one or more calibrated algorithms 457. A calibrated algorithm 457 generated by the calibration module 575 may be a modification of an algorithm received from the mudlogging system 439 through one or more of the communication links 405. Alternatively, a calibrated algorithm 457 may be generated organically by the calibration module 575 based on measurements 437 received from the core sample testing system 450 and/or measurements received from the mudlogging system 439. The calibration module 575 can generate a calibrated algorithm 457 using stored data 534, one or more protocols 532, and/or one or more algorithms 533.

In certain example embodiments, the calibration module 575 of the controller 404 can also be configured to correct one or more calibrated algorithms 457 and/or one or more revised calibrated algorithms 457 based on one or more additional known parameters associated with a field operation. By correcting a calibrated algorithm 457 or a revised calibrated algorithm 457 by the calibration module 575 based on the additional known parameters of the current field operation, an even more accurate output of those calibrated algorithms 457 based on measurements of parameters associated with the return fluid 492 measured and analyzed by the mudlogging system 439 can be achieved.

When the current field operation is or includes drilling the wellbore 120, examples of additional known parameters can include, but are not limited to, a drill rate, a size of the drill bit 108, and the pumping rate of the initial fluid 119 into the wellbore 120. The additional known parameters can be stored data 534 that is retrieved from the storage repository 531 by the calibration module 575. The calibration module 575 of the controller 404 of the calibration system 470 can correct a calibrated algorithm 457 and/or a revised calibrated algorithm 457 using one or more algorithms 533 and/or one or more protocols 532.

The communication module 507 of the controller 404 determines and implements the communication protocol (e.g., from the protocols 532 of the storage repository 531) that is used when the control engine 506 communicates with (e.g., sends signals to, obtains signals from) the user systems 455, the sensor devices 460, the network manager 480, and the other components of the system 400. In some cases, the communication module 507 accesses the stored data 534 to determine which communication protocol is used to communicate with another component of the system 400. In addition, the communication module 507 may identify and/or interpret the communication protocol of a communication obtained by the controller 404 so that the control engine 506 may interpret the communication. The communication module 507 may also provide one or more of a number of other services with respect to data sent from and obtained by the controller 404. Such services may include, but are not limited to, data packet routing information and procedures to follow in the event of data interruption.

The timer 535 of the controller 404 may track clock time, intervals of time, an amount of time, and/or any other measure of time. The timer 535 may also count the number of occurrences of an event, whether with or without respect to time. Alternatively, the control engine 506 may perform a counting function. The timer 535 is able to track multiple time measurements and/or count multiple occurrences concurrently. The timer 535 may track time periods based on an instruction obtained from the control engine 506, based on an instruction obtained from a user 451, based on an instruction programmed in the software for the controller 404, based on some other condition (e.g., the occurrence of an event) or from some other component, or from any combination thereof. In certain example embodiments, the timer 535 may provide a time stamp for each packet of data obtained from another component (e.g., a sensor device 460) of the system 400.

The power module 530 of the controller 404 obtains power from a power supply (e.g., AC mains) and manipulates (e.g., transforms, rectifies, inverts) that power to provide the manipulated power to one or more other components (e.g., the timer 535, the control engine 506) of the controller 404, where the manipulated power is of a type (e.g., alternating current, direct current) and level (e.g., 12V, 24V, 120V) that may be used by the other components of the controller 404. In some cases, the power module 530 may also provide power to one or more of the sensor devices 460.

The power module 530 may include one or more of a number of single or multiple discrete components (e.g., transistor, diode, resistor, transformer) and/or a microprocessor. The power module 530 may include a printed circuit board, upon which the microprocessor and/or one or more discrete components are positioned. In addition, or in the alternative, the power module 530 may be a source of power in itself to provide signals to the other components of the controller 404. For example, the power module 530 may be or include an energy storage device (e.g., a battery). As another example, the power module 530 may be or include a localized photovoltaic power system.

The hardware processor 521 of the controller 404 executes software, algorithms (e.g., algorithms 533), and firmware in accordance with one or more example embodiments. Specifically, the hardware processor 521 may execute software on the control engine 506 or any other portion of the controller 404, as well as software used by the users 451 (including associated user systems 455), the network manager 480, and/or other components of the system 400. The hardware processor 521 may be an integrated circuit, a central processing unit, a multi-core processing chip, SoC, a multi-chip module including multiple multi-core processing chips, or other hardware processor in one or more example embodiments. The hardware processor 521 may be known by other names, including but not limited to a computer processor, a microprocessor, and a multi-core processor.

In one or more example embodiments, the hardware processor 521 executes software instructions stored in memory 522. The memory 522 includes one or more cache memories, main memory, and/or any other suitable type of memory. The memory 522 may include volatile and/or non-volatile memory. The memory 522 may be discretely located within the controller 404 relative to the hardware processor 521. In certain configurations, the memory 522 may be integrated with the hardware processor 521.

In certain example embodiments, the controller 404 does not include a hardware processor 521. In such a case, the controller 404 may include, as an example, one or more field programmable gate arrays (FPGA), one or more insulated-gate bipolar transistors (IGBTs), and/or one or more integrated circuits (ICs). Using FPGAs, IGBTs, ICs, and/or other similar devices known in the art allows the controller 404 (or portions thereof) to be programmable and function according to certain logic rules and thresholds without the use of a hardware processor. Alternatively, FPGAs, IGBTs, ICs, and/or similar devices may be used in conjunction with one or more hardware processors 521.

The transceiver 524 of the controller 404 may send and/or obtain control and/or communication signals. Specifically, the transceiver 524 may be used to transfer data between the controller 404 and the users 451 (including associated user systems 455), the sensor devices 460, the network manager 480, and the other components of the system 400. The transceiver 524 may use wired and/or wireless technology. The transceiver 524 may be configured in such a way that the control and/or communication signals sent and/or obtained by the transceiver 524 may be obtained and/or sent by another transceiver that is part of a user system 455, a sensor device 460, the network manager 480, and/or another component of the system 400. The transceiver 524 may send and/or obtain any of a number of signal types, including but not limited to radio frequency signals.

When the transceiver 524 uses wireless technology, any type of wireless technology may be used by the transceiver 524 in sending and obtaining signals. Such wireless technology may include, but is not limited to, Wi-Fi, Zigbee, VLC, cellular networking, BLE, UWB, and Bluetooth. The transceiver 524 may use one or more of any number of suitable communication protocols (e.g., ISA100, HART) when sending and/or obtaining signals.

Optionally, in one or more example embodiments, the security module 523 secures interactions between the controller 404, the users 451 (including associated user systems 455), the sensor devices 460, the network manager 480, and the other components of the system 400. More specifically, the security module 523 authenticates communication from software based on security keys verifying the identity of the source of the communication. For example, user software may be associated with a security key enabling the software of a user system 455 to interact with the controller 404. Further, the security module 523 may restrict receipt of information, requests for information, and/or access to information.

A user 451 (including an associated user system 455), the sensor devices 460, the network manager 480, and the other components of the system 400 may interact with the controller 404 using the application interface 526. Specifically, the application interface 526 of the controller 404 obtains data (e.g., information, communications, instructions, updates to firmware) from and sends data (e.g., information, communications, instructions) to the user systems 455 of the users 451, the sensor devices 460, the network manager 480, and/or the other components of the system 400. Examples of an application interface 526 may be or include, but are not limited to, an application programming interface, a web service, a data protocol adapter, some other hardware and/or software, or any suitable combination thereof. Similarly, the user systems 455 of the users 451, the sensor devices 460, the network manager 480, and/or the other components of the system 400 may include an interface (similar to the application interface 526 of the controller 404) to obtain data from and send data to the controller 404 in certain example embodiments.

In addition, as discussed above with respect to a user system 455 of a user 451, one or more of the sensor devices 460, the network manager 480, and/or one or more of the other components of the system 400 may include a user interface. Examples of such a user interface may include, but are not limited to, a graphical user interface, a touchscreen, a keyboard, a monitor, a mouse, some other hardware, or any suitable combination thereof.

The controller 404, the users 451 (including associated user systems 455), the sensor devices 460, the network manager 480, and the other components of the system 400 may use their own system or share a system in certain example embodiments. Such a system may be, or contain a form of, an Internet-based or an intranet-based computer system that is capable of communicating with various software. A computer system includes any type of computing device and/or communication device, including but not limited to the controller 404. Examples of such a system may include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system may correspond to a computer system as described below with regard to FIG. 6.

Further, as discussed above, such a system may have corresponding software (e.g., user system software, sensor device software, controller software). The software may execute on the same or a separate device (e.g., a server, mainframe, desktop personal computer (PC), laptop, PDA, television, cable box, satellite box, kiosk, telephone, mobile phone, or other computing devices) and may be coupled by the communication network (e.g., Internet, Intranet, Extranet, LAN, WAN, or other network communication methods) and/or communication channels, with wire and/or wireless segments according to some example embodiments. The software of one system may be a part of, or operate separately but in conjunction with, the software of another system within the testing system 400.

Figure 6:
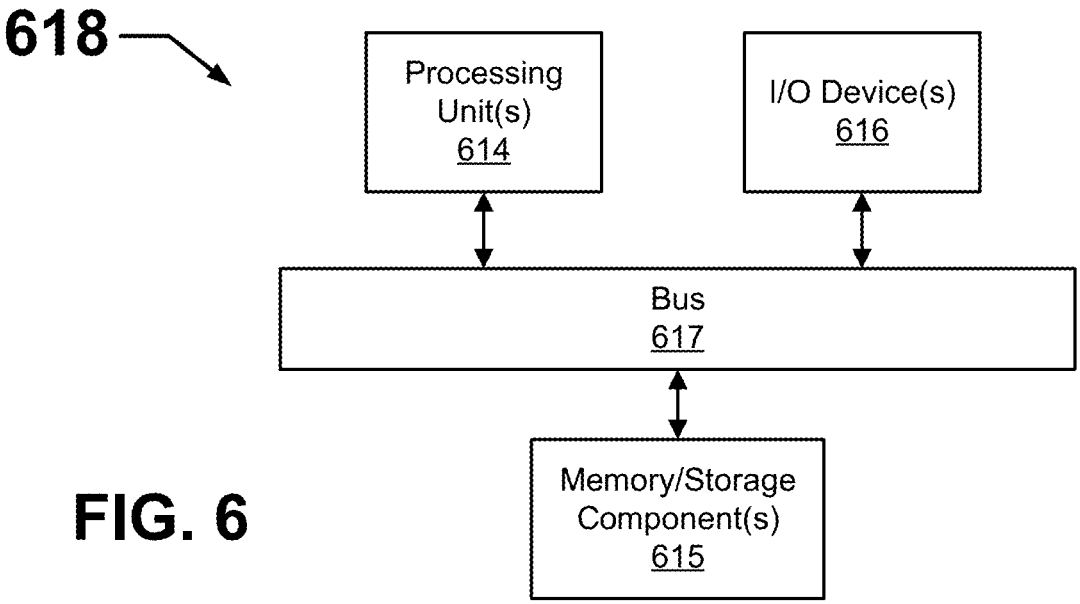
FIG. 6 shows a computing device in accordance with certain example embodiments.

FIG. 6 illustrates one embodiment of a computing device 618 (also sometimes called a computer system 618) that implements one or more of the various techniques described herein, and which is representative, in whole or in part, of the elements described herein pursuant to certain example embodiments. For example, a controller 404 (including components thereof, such as a control engine 506, a hardware processor 521, a storage repository 531, a power module 530, and a transceiver 524) may be considered a computing device 618. Computing device 618 is one example of a computing device and is not intended to suggest any limitation as to scope of use or functionality of the computing device and/or its possible architectures. Neither should the computing device 618 be interpreted as having any dependency or requirement relating to any one or combination of components illustrated in the example computing device 618.

The computing device 618 includes one or more processors or processing units 614, one or more memory/storage components 615, one or more input/output (I/O) devices 616, and a bus 617 that allows the various components and devices to communicate with one another. The bus 617 represents one or more of any of several types of bus structures, including a memory bus or memory controller, a peripheral bus, an accelerated graphics port, and a processor or local bus using any of a variety of bus architectures. The bus 617 includes wired and/or wireless buses.

The memory/storage component 615 represents one or more computer storage media. The memory/storage component 615 includes volatile media (such as random access memory (RAM)) and/or nonvolatile media (such as read only memory (ROM), flash memory, optical disks, magnetic disks, and so forth). The memory/storage component 615 includes fixed media (e.g., RAM, ROM, a fixed hard drive, etc.) as well as removable media (e.g., a Flash memory drive, a removable hard drive, an optical disk, and so forth).

One or more I/O devices 616 allow a user 451 to enter commands and information to the computing device 618, and also allow information to be presented to the user 451 and/or other components or devices. Examples of input devices 616 include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 618 is connected to a network (not shown) (e.g., a LAN, a WAN such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 618 includes at least the minimal processing, input, and/or output means necessary to practice one or more embodiments.

Further, those skilled in the art will appreciate that one or more elements of the aforementioned computer device 618 is located at a remote location and connected to the other elements over a network in certain example embodiments. Further, one or more embodiments is implemented on a distributed system having one or more nodes, where each portion of the implementation (e.g., the mudlogging system 439, the calibration system 470, the core sample testing system 450) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Figure 7:
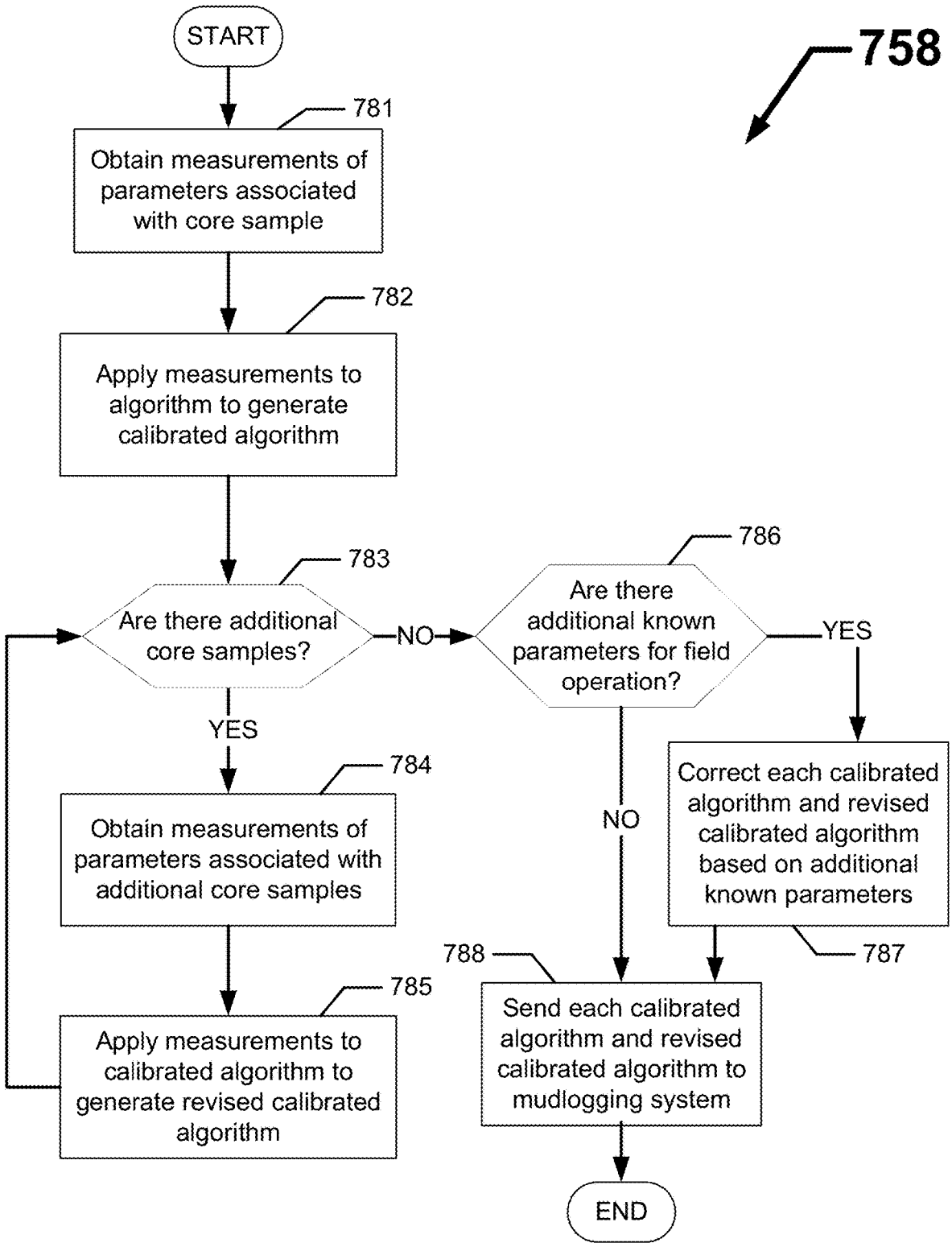
FIG. 7 shows a flowchart of a method for calibrating measurements for mudlogging of a subterranean field operation according to certain example embodiments.

FIG. 7 shows a flowchart 758 of a method for calibrating measurements for mudlogging of a subterranean field operation according to certain example embodiments. While the various steps in this flowchart 758 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 7 may be included in performing this method. Accordingly, the specific arrangement of steps should not be construed as limiting the scope. Further, a particular computing device, such as the computing device 618 discussed above with respect to FIG. 6, may be used to perform one or more of the steps for the methods shown in FIG. 7 in certain example embodiments. Any of the functions performed below by a controller 404 may involve the use of one or more protocols 532, one or more algorithms 533, and/or stored data 534 stored in a storage repository 531. In addition, or in the alternative, any of the functions in the method may be performed by a user (e.g., user 451).

The method shown in FIG. 7 is merely an example that may be performed by using an example system described herein. In other words, systems for calibrating measurements for mudlogging of a subterranean field operation may perform other functions using other methods in addition to and/or aside from those shown in FIG. 7. Referring to FIGS. 1 through 7, the method shown in the flowchart 758 of FIG. 7 begins at the START step and proceeds to step 781, where measurements 437 of parameters associated with a core sample 427 are obtained. As used herein, the term "obtaining" may include receiving, retrieving, accessing, generating, etc. or any other manner of obtaining the information.

The measurements 437 of parameters associated with a core sample 427 may be obtained by the calibration system 470 from the core sample testing system 450. In some cases, there is only a single measurement 437 of a single parameter associated with the core sample 427. In some cases, there are multiple measurements 437 of a single parameter associated with the core sample 427. In some cases, there are measurements 437 of multiple parameters associated with the core sample 427.

The measurements 437 may be obtained by a controller 404 (or an obtaining component thereof), which may include the controller 404 of FIG. 5 above, using one or more algorithms 533 and/or one or more protocols 532. The measurements 437 may be obtained from a user 451, including an associated user system 455. In addition, or in the alternative, the measurements 437 may be obtained from one or more sensor devices 460 that measure various parameters. Examples of the measurements 437 obtained may include, but are not limited to, a volume of a gas (e.g., methane, ethane, propane, butane, pentane) in the core sample 427, a volume of oil in the core sample 427, a fluid saturation level of the core sample 427, a porosity of the core sample 427, a composition of the core sample 427, a temperature of the core sample 427, and a pressure of the core sample 427.

The measurements 437 may be obtained at one time, over a period of time, periodically, or on some other basis. The measurements 437 may be currently measured. In addition, or in the alternative, the measurements 437 may be historical (e.g., measurements 437 made several hours before being obtained by the calibration system 470).

In some cases, the controller 404 of the calibration system 470 may control the core sample testing system 450 (or portions thereof) to dictate which parameters are measured by the core sample testing system 450, when such parameters are measured by the core sample testing system 450, how often (and potentially the measurement intervals) a parameter is measured by the core sample testing system 450, the pressure at which the core sample 427 is tested, the temperature at which the core sample 427 is tested, and/or other factors associated with measuring the parameters of the core sample 427 by the core sample testing system 450. In alternative embodiments, core sample testing system 450 determines one or more factors associated with measuring the parameters of the core sample 427.

In step 782, the measurements 437 are applied to an algorithm to generate a calibrated algorithm 457. Some or all of the measurements 437 may be used to generate the calibrated algorithm 457. In some cases, an average or other representation of multiple measurements 437 may be used to generate the calibrated algorithm 457. For example, if there are three measurements 437 of the same parameter of the core sample 427 taken over time, an average of the three measurements 437 may be used to generate the calibrated algorithm 457. In some cases, more than one calibrated algorithm 457 may be generated using the measurements 437 obtained in step 781.

A calibrated algorithm 457 may be generated by the calibration module 575 of the controller 404 of the calibration system 470 using one or more algorithms 533 and/or one or more protocols 532. A calibrated algorithm 457 is designed to fully characterize the mudlogging system 439, which uses the calibrated algorithm 457. For example, as shown and explained more fully below with respect to FIGS. 9 and 10, the calibrated algorithm 457 allows the measurements of the return fluid 492 made by the mudlogging system 439 to produce more accurate representations of the contents of the subterranean formation.

In step 783, a determination is made as to whether there are additional core samples 427. The determination may be made by a controller 404 using one or more algorithms 533 and/or one or more protocols 532. The determination may be based, at least in part, on information provided by a user 451, data collected from one or more sensor devices 460, a communication from the core sample testing system 450, results of one or more algorithms 533, and/or stored data 534 in the storage repository 531. If there are additional core samples 427, then the process proceeds to step 784. If there are no additional core samples 427, then the process proceeds to step 786.

In step 784, measurements 437 of parameters associated with each additional core sample 427 are obtained. The measurements 437 of parameters associated with each additional core sample 427 may be obtained by the calibration system 470 from the core sample testing system 450. In some cases, there is only a single measurement 437 of a single parameter associated with an additional core sample 427. In some cases, there are multiple measurements 437 of a single parameter associated with an additional core sample 427. In some cases, there are measurements 437 of multiple parameters associated with an additional core sample 427.

The measurements 437 may be obtained by a controller 404 (or an obtaining component thereof), which may include the controller 404 of FIG. 5 above, using one or more algorithms 533 and/or one or more protocols 532. The measurements 437 may be obtained from a user 451, including an associated user system 455. In addition, or in the alternative, the measurements 437 may be obtained from one or more sensor devices 460 that measure various parameters. Examples of the measurements 437 obtained may include, but are not limited to, a volume of a gas (e.g., methane, ethane, propane, butane, pentane) in an additional core sample 427, a volume of oil in an additional core sample 427, a fluid saturation level of an additional core sample 427, a porosity of an additional core sample 427, a composition of an additional core sample 427, a temperature of the core sample 427, and a pressure of an additional core sample 427.

The measurements 437 may be obtained at one time, over a period of time, periodically, or on some other basis. The measurements 437 may be currently measured. In addition, or in the alternative, the measurements 437 may be historical (e.g., measurements 437 made several hours before being obtained by the calibration system 470). In some cases, the controller 404 of the calibration system 470 may control the core sample testing system 450 (or portions thereof) to dictate which parameters are measured by the core sample testing system 450, when such parameters are measured by the core sample testing system 450, how often (and potentially the measurement intervals) a parameter is measured by the core sample testing system 450, the pressure at which an additional core sample 427 is tested, the temperature at which an additional core sample 427 is tested, and/or other factors associated with measuring the parameters of an additional core sample 427 by the core sample testing system 450. In alternative embodiments, core sample testing system 450 determines one or more factors associated with measuring the parameters of an additional core sample 427.

In step 785, the measurements 437 are applied to an algorithm to generate a calibrated algorithm 457. Alternatively, or additionally, the measurements 437 are applied to a calibrated algorithm 457 to generate a revised calibrated algorithm 457. Some or all of the measurements 437 of an additional core sample 427 may be used to generate a calibrated algorithm 457 or a revised calibrated algorithm 457. In some cases, an average or other representation of multiple measurements 437 may be used to generate a calibrated algorithm 457 or a revised calibrated algorithm 457.

For example, if there are three measurements 437 of the same parameter of one additional core sample 427 taken over time, an average of the three measurements 437 may be used to generate the calibrated algorithm 457. As another example, if there is one measurement 437 of the same parameter for five different core samples 427, an average of the five measurements 437 may be used to generate a calibrated algorithm 457 and/or a revised calibrated algorithm 457. In some cases, more than one calibrated algorithm 457 and/or more than one revised calibrated algorithm 457 may be generated using the measurements 437 obtained in step 784.

A calibrated algorithm 457 and/or a revised calibrated algorithm 457 may be generated by the calibration module 575 of the controller 404 of the calibration system 470 using one or more algorithms 533 and/or one or more protocols 532. A calibrated algorithm 457 and/or a revised calibrated algorithm 457 is designed to fully characterize the mudlogging system 439, which uses the calibrated algorithm 457 and/or the revised calibrated algorithm 457. After step 785 is complete, the process reverts to step 783.

In step 786, a determination is made as to whether there are additional known parameters for a field operation. Examples of additional known parameters when the field operation is drilling a wellbore may include, but are not limited to, the drill rate, the size of the drill bit (e.g., drill bit 108), and the volume of the pump of the circulation system 109 that circulates the initial fluid (e.g., initial fluid 119) downhole and returns the return fluid (e.g., return fluid 192, return fluid 492) uphole (e.g., through the annulus 123). The determination may be made by the controller 404 (or a determining portion thereof) of the calibration system 470 using one or more algorithms 533 and/or one or more protocols 532. The determination may be based, at least in part, on information provided by a user 451, data collected from one or more sensor devices 460, results of one or more algorithms 533, and/or stored data 534 in the storage repository 531. If there are additional known parameters for a field operation, the process proceeds to step 787. If there are no additional known parameters for a field operation, the process proceeds to step 788.

Figure 9:
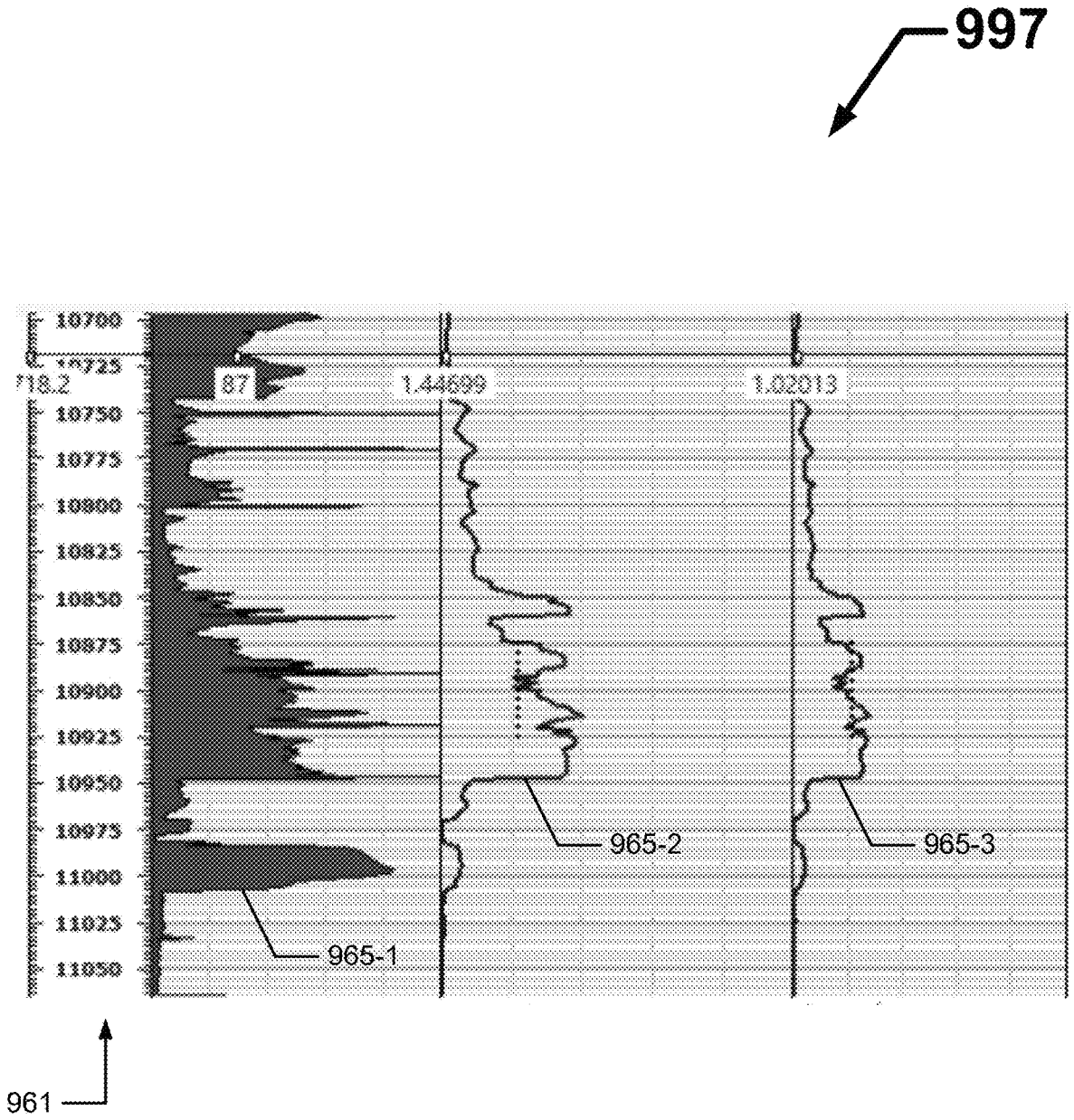
FIG. 9 shows a graph of mudlogging results according to certain example embodiments.

In step 787, each calibrated algorithm 457 and revised calibrated algorithm 457 is corrected based on the additional known parameters. An example of this is shown in FIG. 9 below. A calibrated algorithm 457 or a revised calibrated algorithm 457 that is corrected is designed to consider the additional known parameters of the current field operation to provide a more accurate output based on measurements of parameters associated with the return fluid 492 measured and analyzed by the mudlogging system 439. A calibrated algorithm 457 and/or a revised calibrated algorithm 457 may be corrected by the calibration module 575 of the controller 404 of the calibration system 470 using one or more algorithms 533 and/or one or more protocols 532. When step 787 is complete, the process proceeds to step 788.

In step 788, each calibrated algorithm 457 and revised calibrated algorithm 457, whether corrected or not, is sent to the mudlogging system 439. Each calibrated algorithm 457 and revised calibrated algorithm 457, whether corrected or not, may be sent from the calibration system 470 to the mudlogging system 439 using one or more of the communication links 405. Each calibrated algorithm 457 and revised calibrated algorithm 457 may be sent by a controller 404 (or a sending component thereof) of the calibration system 470, which may include the controller 404 of FIG. 5 above, using one or more algorithms 533 and/or one or more protocols 532. When step 788 is complete, the process ends at the END step.

Figure 8:
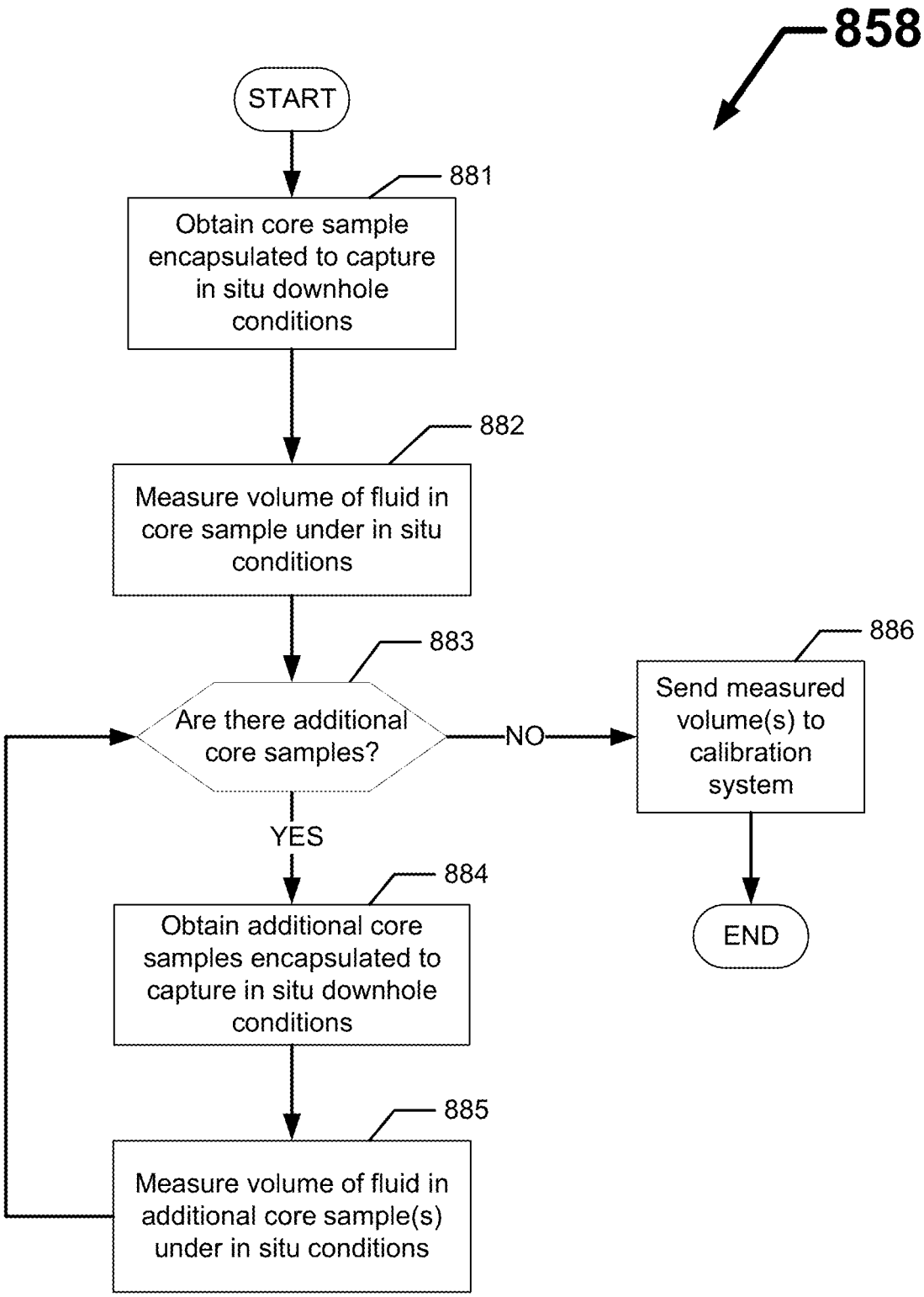
FIG. 8 shows a flowchart of a method for testing a core sample to calibrate gas volume measurements during a subterranean field operation according to certain example embodiments.

FIG. 8 shows a flowchart 858 of a method for testing a core sample to calibrate gas volume measurements during a subterranean field operation according to certain example embodiments. While the various steps in this flowchart 858 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 8 may be included in performing this method. Accordingly, the specific arrangement of steps should not be construed as limiting the scope. Further, a particular computing device, such as the computing device 618 discussed above with respect to FIG. 6, may be used to perform one or more of the steps for the methods shown in FIG. 8 in certain example embodiments. Any of the functions performed below by a controller 404 may involve the use of one or more protocols 532, one or more algorithms 533, and/or stored data 534 stored in a storage repository 531. In addition, or in the alternative, any of the functions in the method may be performed by a user (e.g., user 451).

The method shown in FIG. 8 is merely an example that may be performed by using an example system described herein. In other words, systems for testing a core sample to calibrate gas volume measurements during a subterranean field operation may perform other functions using other methods in addition to and/or aside from those shown in FIG. 8. Referring to FIGS. 1 through 8, the method shown in the flowchart 858 of FIG. 8 begins at the START step and proceeds to step 881, where a core sample 427 encapsulated to capture in situ downhole conditions is obtained. A single core sample 427 or multiple core samples 427 may be obtained. When multiple core samples 427 are obtained, they may be obtained at the same time or over a period of time. The core sample 427 may be obtained by the core sample testing system 450 from one or more core sample retrieving tools 495.

In step 882, a volume of fluid in the core sample 427 is measured under the in situ conditions. The volume of fluid measured in the core sample 427 may be a measurement 437 where the parameter is the volume of the fluid. The fluid may be a gas (e.g., methane, ethane, propane, butane, pentane), water, oil, and/or some other fluid. In addition to a volume of fluid, or as an alternative to a volume of fluid, one or more other parameters associated with the core sample 427 under in situ conditions may be measured. Examples of other parameters may include, but are not limited to, a fluid saturation level of the core sample 427, a porosity of the core sample 427, a composition of the core sample 427, a temperature of the core sample 427, and a pressure of the core sample 427.

The volume of fluid and/or other parameter may be measured by one or more sensor devices 460 and subsequently obtained by a controller 404 (or an obtaining component thereof), which may include the controller 404 of FIG. 5 above, using one or more algorithms 533 and/or one or more protocols 532. A sensor device 460 used to measure the volume of fluid and/or other parameter may be controlled by a controller 404, the network manager 480, or a user 451, including an associated user system 455. A parameter (e.g., a volume of fluid) in the core sample 427 may be obtained at one time, over a period of time, periodically, or on some other basis.

In some cases, the controller 404 of the calibration system 470 may control the core sample testing system 450 (or portions thereof) to dictate which parameters are measured by the core sample testing system 450, when such parameters are measured by the core sample testing system 450, how often (and potentially the measurement intervals) a parameter is measured by the core sample testing system 450, the pressure at which the core sample 427 is tested, the temperature at which the core sample 427 is tested, and/or other factors associated with measuring the parameters of the core sample 427 by the core sample testing system 450. In alternative embodiments, core sample testing system 450 determines one or more factors associated with measuring the parameters of the core sample 427.

In step 883, a determination is made as to whether there are additional core samples 427. The determination may be made by a controller 404 using one or more algorithms 533 and/or one or more protocols 532. The determination may be based, at least in part, on information provided by a user 451, data collected from one or more sensor devices 460, a communication from the core sample testing system 450, results of one or more algorithms 533, and/or stored data 534 in the storage repository 531. If there are additional core samples 427, then the process proceeds to step 884. If there are no additional core samples 427, then the process proceeds to step 886.

In step 884, one or more additional core samples 427 encapsulated to capture in situ downhole conditions is obtained. A single additional core sample 427 or multiple additional core samples 427 may be obtained. When multiple additional core samples 427 are obtained, they may be obtained at the same time or over a period of time. The additional core sample 427 may be obtained by the core sample testing system 450 from one or more core sample retrieving tools 495.

In step 885, a volume of fluid in an additional core sample 427 is measured under the in situ conditions. The volume of fluid measured in the additional core sample 427 may be a measurement 437 where the parameter is the volume of the fluid. The fluid may be a gas (e.g., methane, ethane, propane, butane, pentane), water, oil, and/or some other fluid. In addition to a volume of fluid, or as an alternative to a volume of fluid, one or more other parameters associated with an additional core sample 427 under in situ conditions may be measured. Examples of other parameters may include, but are not limited to, a fluid saturation level of the additional core sample 427, a porosity of the additional core sample 427, a composition of the additional core sample 427, a temperature of the additional core sample 427, and a pressure of the additional core sample 427.

The volume of fluid and/or other parameter may be measured by one or more sensor devices 460 and subsequently obtained by a controller 404 (or an obtaining component thereof), which may include the controller 404 of FIG. 5 above, using one or more algorithms 533 and/or one or more protocols 532. A sensor device 460 used to measure the volume of fluid and/or other parameter may be controlled by a controller 404, the network manager 480, or a user 451, including an associated user system 455. A parameter (e.g., a volume of fluid) in an additional core sample 427 may be obtained at one time, over a period of time, periodically, or on some other basis.

In some cases, the controller 404 of the calibration system 470 may control the core sample testing system 450 (or portions thereof) to dictate which parameters are measured by the core sample testing system 450, when such parameters are measured by the core sample testing system 450, how often (and potentially the measurement intervals) a parameter is measured by the core sample testing system 450, the pressure at which the additional core sample 427 is tested, the temperature at which the additional core sample 427 is tested, and/or other factors associated with measuring the parameters of the additional core sample 427 by the core sample testing system 450. In alternative embodiments, core sample testing system 450 determines one or more factors associated with measuring the parameters of the additional core sample 427. When step 885 is complete, the process reverts to step 883.

In step 886, each measured volume (or other measurement 437) is sent to the calibration system 470. Each measured volume (or other measurement 437) may be sent from the core sample testing system 450 to the calibration system 470 using one or more of the communication links 405. Each measured volume (or other measurement 437) may be sent by a controller 404 (or a sending component thereof) of the core sample testing system 450, which may include the controller 404 of FIG. 5 above, using one or more algorithms 533 and/or one or more protocols 532. When step 886 is complete, the process ends at the END step.

FIG. 9 shows a graph 997 of mudlogging results according to certain example embodiments. Referring to FIGS. 1 through 9, the graph 997 of FIG. 9 has three plots 965 of gas values over a range of depths 961 within a wellbore (e.g., wellbore 120) in a traditional mudlogging format. Plot 965-1 shows raw gas-in-air values measured from the return fluid (e.g., return fluid 492) by the mudlogging system 439 during drilling (a type of field operation) of a wellbore (e.g., wellbore 120). Plot 965-2 shows corrected gas-in-air values relative to the raw gas-in-air values in plot 965-1. Specifically, plot 965-2 corrects the gas-in-air values by accounting for one or more additional known parameters for the field operation, as discussed above with respect to step 787 in FIG. 7. In this case, the values in plot 965-2 are corrected for drill rate, the size of the drill bit (e.g., drill bit 108), and pump volume for circulating the initial fluid (e.g., initial fluid 119) and return fluid (e.g., return fluid 192, return fluid 492). The values in the plot 965-2 are presented as gas values measured at the surface (e.g., surface 102) per cubic foot of rock drilled. The actual mud gas volumes are unknown and are plotted with the known average gas volumes from the recovered rock samples in the return fluid.

Plot 965-3 shows gas-in-air values using example embodiments. Specifically, plot 965-3 shows the mud gas values measured during drilling that are calibrated, using measurements (e.g., measurements 437) of parameters of one or more core samples (e.g., core sample 427), to match the average known volumes of gas recovered from the rock sample in the return fluid (e.g., return fluid 492) after being run through a calibrated algorithm 457. The values in plot 965-3 are now presented as cubic feet of gas measured at the surface per cubic feet of rock drilled. These values in plot 965-3 are significantly more accurate compared to the values in plot 965-1 and plot 965-2. The values in plot 965-3 may also be used to better compare gas volumes to other ranges of depth 961 of the wellbore and/or other wellbores (e.g., offset wells).

The graph 997 of FIG. 9 shows that the calibrated algorithm 457 generated by the calibration system 470 and used by the mudlogging system 439 is configured to generate gas volumes for a range of depths of the subterranean formation 110, where the range of depths of the return fluids 492 in the wellbore 120 includes a depth from which the one or more core samples 427 is retrieved. In some cases, the calibrated algorithm 457 may also be used for return fluids 492 from depths of the return fluids 492 in the wellbore 120 outside this range.

Table 1 below shows an example of a process used to arrive at the plot 965-3 of the graph 997 of FIG. 9. The columns in Table 1 are for the light hydrocarbons (C1, C2, C3, C4, and C5) and a total. In this case, the process may start with obtaining measurements of parameters associated with the light hydrocarbons found in the return fluids 492 in the mudlogging process. Line 1 in Table 1 shows an example of the measurements for each of the light hydrocarbons in the return fluids 492. Next, shown in line 2 of Table 1, the percentage of each of the light hydrocarbons found in the return fluid 492 is calculated. Next, shown in line 3 of Table 1, a gas analysis is performed by the core sample testing system 450 on the core samples 427 retrieved from approximately the same depth in the wellbore 120 as the return fluids 492.

Next, shown in line 4 of Table 1, the percentage of each of the light hydrocarbons found in the core samples 427 is calculated. Next, shown in line 5 of Table 1, a ratio of the percentage of each light hydrocarbon in the return fluid 492 versus in the core samples 427 is calculated. Next, shown in line 6 of Table 1, a ratio of each light hydrocarbon (from line 5 in Table 1) to C1 is calculated. Next, shown in line 7 of Table 1, a corrected gas-in-mud value relative to C1 is calculated. Specifically, for each light hydrocarbon, the measurement value in line 1 of Table 1 is divided by the ratio for that light hydrocarbon in line 6 of Table 1. The values shown in line 7 of Table 1 are based on ratios in line 6 of Table 1 that are extended beyond the 2 decimal places shown. Next, in line 8 of Table 1, a corrected percent based on the values in line 7 of Table 1 is calculated for each light hydrocarbon. All of the calculations in Table 1 can be performed by the calibration system 470.

TABLE 1

| Line | Step in Process | C1 | C2 | C3 | C4 | C5 | Total |
|---|---|---|---|---|---|---|---|
| 1 | Measurements from mudlogging (PPM) | 61554 | 3547 | 1375 | 473 | 75 | 67023 |
| 2 | Percent | 91.84% | 5.29% | 2.05% | 0.71% | 0.11% | 100.00% |
| 3 | Core sample gas (Mole %) | 0.6408 | 0.10 | 0.12 | 0.10 | 0.04 | 1 |
| 4 | Percent | 64.08% | 10.32% | 11.98% | 9.55% | 4.07% | 100.00% |
| 5 | Ratio of Line 2 to Line 4 | 1.43 | 0.51 | 0.17 | 0.07 | 0.03 | 1 |
| 6 | Ratio of Line 5 to value of C1 in Line 5 | 1.00 | 0.36 | 0.12 | 0.05 | 0.02 | |
| 7 | Corrected Gas-In-Mud Relative to C1 (PPM) | 61554 | 9918 | 11505 | 9170 | 3912 | 96058 |
| 8 | Corrected Percent | 64.08% | 10.32% | 11.98% | 9.55% | 4.07% | 100.00% |

It should be noted that measurements 437 by the core sample testing system 450 of the core samples 427 may include gas components that are heavier than C5, but the mudlogging system 439 typically provides measurements of only C1 through C5. Fluid character equations can include the following:

$$\text{Relative weight oil} = 3070 \times (C3 \times C5) \div C4 \times sqrt(C2 \times C4) \text{ when values for } C1 \text{ through } C5 \text{ are measured.} \quad (1)$$

$$\text{Relative weight oil} = 1932 \times C4^2 \div sqrt(C2 \times C3) \text{ when values for } C1 \text{ through } C4 \text{ (not } C5\text{) are measured.} \quad (2)$$

$$\text{Estimated Gas-To-Oil Ratio} = 100000 \times (C1 + C2 + C3 + C4) \div \text{Relative weight oil} \quad (3)$$

Figure 10:
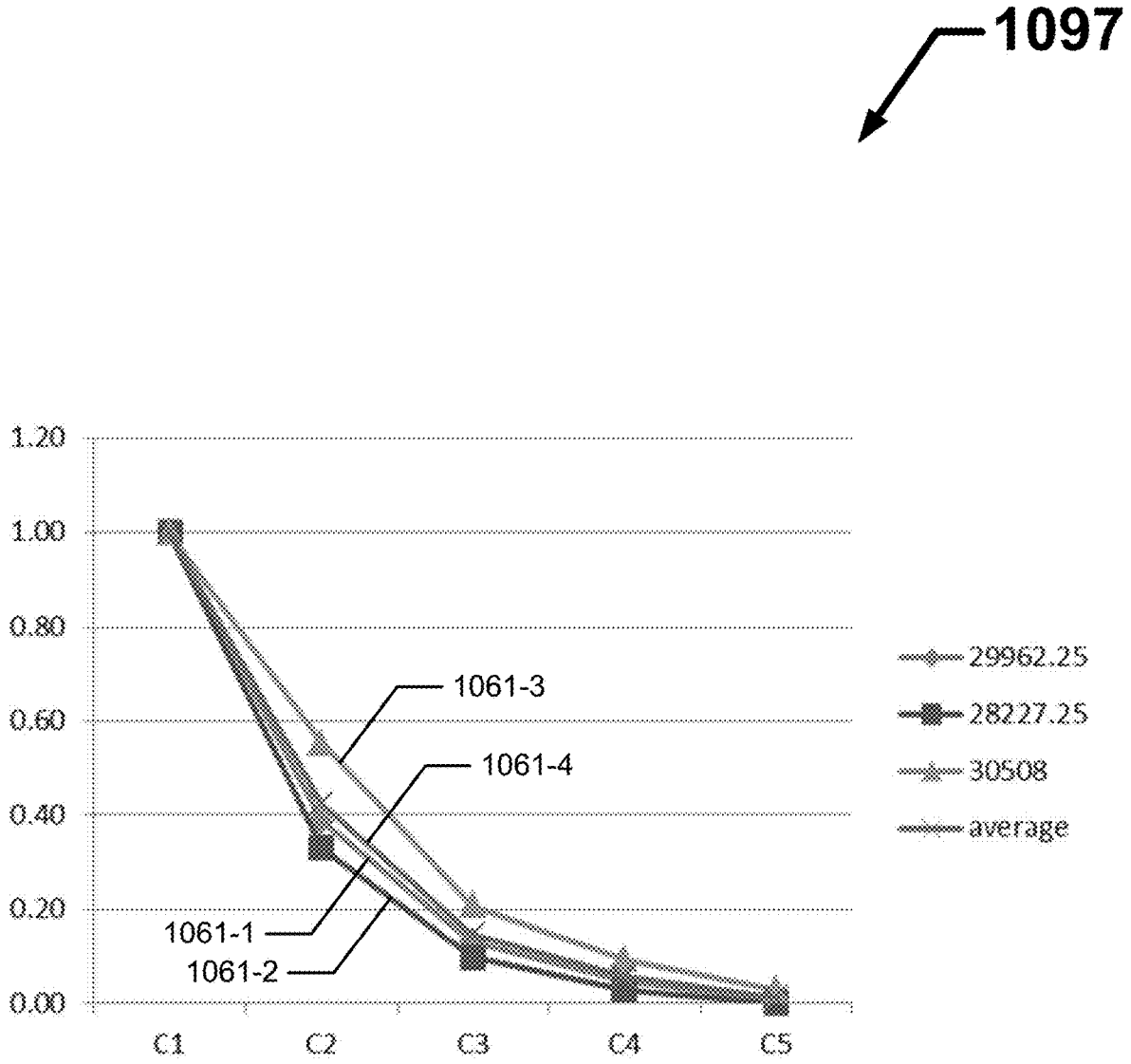
FIG. 10 shows a graph of extraction efficiency for gas components relative to methane according to certain example embodiments.

FIG. 10 shows a graph 1097 of extraction efficiency for gas components relative to methane according to certain example embodiments. Referring to FIGS. 1 through 10, the graph 1097 of FIG. 10 shows four plots 1061 of relative extraction efficiency along the vertical axis for the five light hydrocarbons (methane through pentane) along the horizontal axis. Each plot 1061 corresponds to a depth in the wellbore (e.g., wellbore 120) from which contents (e.g., cuttings, light hydrocarbon gases) are retrieved, measured, and analyzed from the return fluid (e.g., return fluid 492) by the mudlogging system 439 using one or more calibrated algorithms 457.

Specifically, an example calibration system (e.g., calibration system 470) may use measurements (e.g., measurements 437) of one or more parameters of one or more core samples (e.g., core samples 427), as measured by a core sample testing system (e.g., core sample testing system 450) under in situ conditions, to generate one or more calibrated algorithms (e.g., calibrated algorithms 457) that are used by a mudlogging system (e.g., mudlogging system 439). In some cases, the calibration system 470 may compare measurements 437 in the form of gas analysis of gas concentrations of the core samples 427 with gas values of the return fluid 492 measured during drilling of the same depth interval in the wellbore 120. This comparison allows for calibration of each gas component in the return fluid 492 and will be of use to better improve hydrocarbon character estimates for a given drilling fluid type.

Each of the plots 1061 in FIG. 10 shows the relative extraction efficiency (relative response) for each component relative to methane (C1). The corrected gas values are a better representation of actual formation fluid character. The relative response factors for each gas component of interest may be used for correcting additional gas trap values measured in the same well by the mudlogging system 439 or for correcting gas trap values measured in surrounding wells utilizing a similar drilling fluid (e.g., initial fluid 119). The corrected gas trap values for each of the gas components of interest may be utilized to calculate gas/oil ratios for characterizing the formation fluid from the volume of drilling mud (e.g., return fluid 492).

Plot 1061-1 in FIG. 10 is at a depth of 29962.25 feet of depth in the wellbore 120. At this depth, the relative extraction efficiency of C1 (methane) is 1.00, the relative extraction efficiency of C2 (ethane) is approximately 0.39, the relative extraction efficiency of C3 (propane) is approximately 0.14, the relative extraction efficiency of C4 (butane) is approximately 0.04, and the relative extraction efficiency of C5 (pentane) is approximately 0.02. Plot 1061-2 in FIG. 10 is at a depth of 28227.25 feet of depth in the wellbore 120. At this depth, the relative extraction efficiency of C1 (methane) is 1.00, the relative extraction efficiency of C2 (ethane) is approximately 0.35, the relative extraction efficiency of C3 (propane) is approximately 0.10, the relative extraction efficiency of C4 (butane) is approximately 0.02, and the relative extraction efficiency of C5 (pentane) is approximately 0.00.

Plot 1061-3 in FIG. 10 is at a depth of 30508.00 feet of depth in the wellbore 120. At this depth, the relative extraction efficiency of C1 (methane) is 1.00, the relative extraction efficiency of C2 (ethane) is approximately 0.55, the relative extraction efficiency of C3 (propane) is approximately 0.21, the relative extraction efficiency of C4 (butane) is approximately 0.10, and the relative extraction efficiency of C5 (pentane) is approximately 0.04. Plot 1061-4 in FIG. 10 is an average of the other three plots 1061. The average relative extraction efficiency of C1 (methane) is 1.00, the average relative extraction efficiency of C2 (ethane) is approximately 0.42, the average relative extraction efficiency of C3 (propane) is approximately 0.15, the relative extraction efficiency of C4 (butane) is approximately 0.06, and the relative extraction efficiency of C5 (pentane) is approximately 0.02.

Example embodiments may be used to provide more accurate mudlogging results by calibrating and correcting one or more algorithms used by a mudlogging system. An algorithm may be calibrated by taking measurements of one or more parameters associated with one or more core samples that are captured from a wellbore and tested under in situ conditions. These measurements may be for one or more gas volumes (e.g., light hydrocarbons) in the core samples. These measurements provide an accurate quantity of what exists in a subterranean formation at a range of depths, and so these measurements may be used to calibrate what is captured, measured, and analyzed in return fluids during the mudlogging process. One or more algorithms may be corrected by integrated additional known parameters (e.g., drill rate, drill bit size, pump volume) associated with a field operation. Example embodiments may be used in unconventional formations, such as shale. Example embodiments may provide a number of benefits. Such benefits may include, but are not limited to, ease of use, extending the life of a producing well, increased flexibility, configurability, and compliance with applicable industry standards and regulations.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for measuring gas volume during mudlogging of a subterranean field operation, the method comprising:

obtaining measurements from a plurality of sensor devices for a plurality of parameters associated with a core sample retrieved from a depth in a wellbore in a subterranean formation, wherein the plurality of parameters are measured by the plurality of sensor devices while the core sample is under downhole conditions, wherein the plurality of sensor devices comprises a gas chromatograph, and wherein the plurality of parameters comprises a volume of a fluid in a gaseous state and a composition of the fluid in the gaseous state;

applying the measurements to an algorithm to generate a calibrated algorithm that yields the volume of the fluid having the composition in the gaseous state over a range of depths within the wellbore, wherein the range of depths comprises the depth at which the core sample is retrieved; and sending the calibrated algorithm to a mudlogging system, wherein the mudlogging system is configured to use the calibrated algorithm during the mudlogging to improve an extraction efficiency of the fluid having the composition in the gaseous state during the subterranean field operation.

2. The method of claim 1, wherein the mudlogging system is further configured to use the calibrated algorithm during the mudlogging to improve the extraction efficiency of oil during the subterranean field operation.

3. The method of claim 1, wherein the plurality of parameters further comprises a fluid saturation level.

4. The method of claim 1, wherein the plurality of parameters further comprises a porosity.

5. The method of claim 1, wherein the subterranean formation is unconventional.

6. The method of claim 1, wherein the calibrated algorithm is further calibrated by applying an additional factor to the algorithm, and wherein the additional factor comprises at least one of a group consisting of a drill rate, a drill bit size, and a flow rate capacity of a pump.

7. The method of claim 1, wherein the fluid in the gaseous state comprises at least one of a group consisting of ethane, methane, propane, butane, and pentane.

8. The method of claim 1, wherein the downhole conditions comprise a downhole temperature and a downhole pressure.

9. The method of claim 1, further comprising:

obtaining additional measurements for the plurality of parameters associated with an additional core sample retrieved from a second depth in the wellbore in the subterranean formation, wherein the plurality of parameters are measured by the plurality of sensor devices while the additional core sample is under the downhole conditions, and wherein the plurality of parameters comprises a second volume and the composition of the fluid in the gaseous state;

applying the additional measurements to the algorithm to generate a revised calibrated algorithm that yields the second volume of the fluid having the composition in the gaseous state over a second range of depths within the wellbore, wherein the second range of depths comprises the second depth at which the additional core sample is retrieved, wherein the revised calibrated algorithm is used to generate gas volumes based on the measurements made during the mudlogging; and sending the revised calibrated algorithm to the mudlogging system, wherein the mudlogging system is further configured to use the revised calibrated algorithm during the mudlogging to improve the extraction efficiency of the fluid having the composition in the gaseous state during the subterranean field operation.

10. The method of claim 9, wherein the revised calibrated algorithm is configured to generate the gas volumes for the range of depths of the subterranean formation, and wherein the range of depths includes the second depth from which the additional core sample is retrieved.

11. The method of claim 9, wherein the measurements and the additional measurements are averaged before being applied to the algorithm.

12. The method of claim 1, further comprising:

obtaining additional measurements for the plurality of parameters associated with an additional core sample retrieved from a second depth in the wellbore in the subterranean formation, wherein the plurality of parameters are measured by the plurality of sensor devices while the additional core sample is the under downhole conditions, wherein the second depth falls within the range of depths within the wellbore, and wherein the plurality of parameters comprises a second volume and the composition of the fluid in the gaseous state; and applying the additional measurements, along with the measurements, to the algorithm to generate the calibrated algorithm.

13. The method of claim 1, wherein the mudlogging system is configured to use the calibrated algorithm by correcting second measurements made in return fluids collected during the mudlogging based on the measurements of the core sample.

14. A system for calibrating gas volume measurements during mudlogging of a subterranean field operation, the system comprising:

a calibration engine that is configured to:

obtain, from a core sample testing system, measurements for a plurality of parameters associated with a core sample retrieved from a depth in a wellbore in a subterranean formation, wherein the plurality of parameters are measured by a plurality of sensor devices while the core sample is under downhole conditions, wherein the plurality of sensor devices comprises a gas chromatograph, and wherein the plurality of parameters comprises a volume of a fluid in a gaseous state and a composition of the fluid in the gaseous state;

apply the measurements to an algorithm to generate a calibrated algorithm that yields the volume of the fluid having the composition in the gaseous state over a range of depths within the wellbore, wherein the range of depths comprises the depth at which the core sample is retrieved; and send the calibrated algorithm to a mudlogging system, wherein the mudlogging system is configured to use the calibrated algorithm during the mudlogging to improve an extraction efficiency of the fluid having the composition in the gaseous state during the subterranean field operation.

15. The system of claim 14, further comprising:

a communication module that is configured to send the calibrated algorithm to the mudlogging system.

16. The system of claim 14, wherein the calibration engine is further configured to:

obtain an additional factor associated with the subterranean field operation; and apply the additional factor along with the measurements to the algorithm to generate the calibrated algorithm, wherein the additional factor comprises at least one of a group consisting of a drill rate, a drill bit size, and a flow rate capacity of a pump.

17. A method for testing a core sample to calibrate gas volume measurements during mudlogging of a subterranean field operation, the method comprising:

obtaining the core sample encapsulated to capture in situ conditions present at a depth in a wellbore in a subterranean formation from which the core sample is retrieved, wherein the in situ conditions comprise a pressure and a temperature;

measuring, using a plurality of sensor devices, a volume of fluid in the core sample at the in situ conditions, wherein the plurality of sensor devices comprises a gas chromatograph, wherein the fluid comprises a chemical composition in a gaseous state; and sending a measurement of the volume of the fluid to a calibration system, wherein the calibration system is configured to use the measurement of the volume of the fluid to generate a calibrated algorithm that is used during the mudlogging to improve an extraction efficiency of the fluid during the subterranean field operation.

18. The method of claim 17, wherein the fluid comprises a hydrocarbon.

19. The method of claim 17, further comprising:

obtaining an additional core sample encapsulated to capture second in situ conditions present at a second depth in the wellbore in the subterranean formation from which the additional core sample is retrieved;

measuring, using the plurality of sensor devices, a second volume of the fluid in the additional core sample at the second in situ conditions; and sending a second measurement of the second volume of the fluid to the calibration system, wherein the calibration system is configured to use the second measurement of the second volume of the fluid of the additional core sample to generate a second calibrated algorithm that is used during the mudlogging to improve the extraction efficiency of the fluid during the subterranean field operation.

* * * * *